US010189604B2

(12) United States Patent
McMunn

(10) Patent No.: US 10,189,604 B2
(45) Date of Patent: Jan. 29, 2019

(54) CONTAINER, PACKAGING, AND METHOD FOR PRODUCING SAME

(71) Applicant: Kevin Ralph McMunn, Fort McMurray (CA)

(72) Inventor: Kevin Ralph McMunn, Fort McMurray (CA)

( * ) Notice: Subject to any disclaimer, the term of this patent is extended or adjusted under 35 U.S.C. 154(b) by 0 days.

(21) Appl. No.: 15/502,667

(22) PCT Filed: Aug. 19, 2015

(86) PCT No.: PCT/CA2015/050785
§ 371 (c)(1),
(2) Date: Feb. 8, 2017

(87) PCT Pub. No.: WO2016/033682
PCT Pub. Date: Mar. 10, 2016

(65) Prior Publication Data

US 2017/0233140 A1 Aug. 17, 2017

Related U.S. Application Data

(60) Provisional application No. 62/167,981, filed on May 29, 2015, provisional application No. 62/045,050, filed on Sep. 3, 2014.

(51) Int. Cl.

| | |
|---|---|
| ***B65D 25/14*** | (2006.01) |
| ***B65D 25/34*** | (2006.01) |
| ***B65D 43/02*** | (2006.01) |
| ***B65D 53/02*** | (2006.01) |
| ***B65D 65/38*** | (2006.01) |

(52) U.S. Cl.
CPC ..... *B65D 25/14* (2013.01); *B65D 25/34* (2013.01); *B65D 43/0225* (2013.01); *B65D 53/02* (2013.01); *B65D 65/38* (2013.01)

(58) Field of Classification Search
CPC ..... B65D 25/14; B65D 65/38; B65D 25/34; B65D 53/02; B65D 43/0225
USPC ..... 220/574.3, 1.6, 495.01–495.11, 23.9, 220/62.21, 908.1
See application file for complete search history.

(56) References Cited

U.S. PATENT DOCUMENTS 3,537,866 A 11/1970 Weller et al.
3,734,393 A 5/1973 Stump
(Continued)

FOREIGN PATENT DOCUMENTS

CN 2311197 Y 3/1999
CN 2690336 Y 4/2005
(Continued)

OTHER PUBLICATIONS

Document relating to PCT Application No. PCT/CA2015/050785, dated Oct. 6, 2015 (International Search Report and Written Opinion).

(Continued)

*Primary Examiner* — Kareen K Thomas
(74) *Attorney, Agent, or Firm* — ABM Intellectual Property Inc.; Adrienne Bieber McNeil

(57) ABSTRACT

A container comprises a plant based structural layer having an inner surface and an opposed outer surface, and a pre-formed polymeric liner layer secured to the plant based structural layer and lining at least one of the inner surface and the outer surface.

12 Claims, 17 Drawing Sheets

(56) References Cited

U.S. PATENT DOCUMENTS

| | | | | |
|---|---|---|---|---|
| 4,196,034 | A | 4/1980 | Kimura | |
| 6,200,644 | B1 | 3/2001 | Ulfstedt et al. | |
| 7,115,310 | B2 | 10/2006 | Jaccoud | |
| D636,670 | S * | 4/2011 | Schedl | D9/435 |
| 8,304,004 | B2 * | 11/2012 | Sanders | B65D 65/403 229/406 |
| 2007/0131750 | A1 * | 6/2007 | Drummond | B65D 3/22 229/123.1 |
| 2010/0084361 | A1 | 4/2010 | Dayton et al. | |
| 2012/0276400 | A1 | 11/2012 | Nilsson | |
| 2015/0203270 | A1 | 7/2015 | Lee et al. | |

FOREIGN PATENT DOCUMENTS

| | | | |
|---|---|---|---|
| CN | 203229007 | U | 10/2013 |
| EP | 0120079 | B1 | 8/1989 |
| FR | 1462554 | A | 12/1966 |
| JP | 2002363881 | A | 12/2002 |
| KR | 20090002264 | A | 3/2009 |
| KR | 20130062856 | A | 6/2013 |
| WO | 2011159240 | A1 | 12/2011 |

OTHER PUBLICATIONS

Kris Verschueren and Christian Parein, "Silicone Coatings Offer New Opportunities for Food Contact Paper Performance", Dow Corning Europe S. A., pp. 1-6 (2012). Downloaded: Jul. 9, 2014. Available Online: https://www.dowcorning.com/content/publishedlit/30-1247-01.pdf.

Kalico Products, "Silicone Release Packaging—Meltpack Cartons". Downloaded: Jul. 9, 2014. Available Online: http://www.kalicoproducts.com/Meltpak_Cartons.htm.

Kalico Products, "Silicone Release Packaging—Cellpak Cartons". Downloaded: Jul. 9, 2014. Available Online: http://www.kalicoproducts.com/Cellpack_Cartons.htm.

* cited by examiner

CONTAINER, PACKAGING, AND METHOD FOR PRODUCING SAME

CROSS-REFERENCE TO RELATED APPLICATIONS

This application is a national phase entry of PCT Patent Application No. PCT/CA2015/050785, filed Aug. 19, 2015, which claims the benefit of U.S. Provisional Patent Application No. 62/045,050 filed Sep. 3, 2014, and U.S. Provisional Patent Application No. 62/167,981 filed May 29, 2015, each of which is incorporated herein by reference in its entirety.

FIELD

The specification relates to containers and packaging, such as for food or cosmetics. More particularly, the specification relates to containers and packaging that include two or more layers of material, and to methods for producing such containers and packaging.

BACKGROUND

U.S. Pat. No. 6,200,644 (Ulfstedt et al.) purports to disclose methods for manufacturing liquid-tight and gas-tight packaging board, and a package and products provided according to the said methods. According to the invention, a polymerizing reaction mixture is spread on paper or a board base of paperboard or cardboard, the mixture containing at least one silicon compound forming an inorganic, chain or cross-linked polymeric backbone containing alternating silicon and oxygen atoms, and at least one reactive, organic compound forming organic side chains and/or cross-links in the polymeric backbone. The reaction mixture may form a colloidal solution in which, along with the polymerization, gelling takes place, whereupon the thus created gel is dried, densified and cured to form a liquid-tight and gas-tight layer of coating. In addition to oxygen and silicon, the said chain-like or cross-linked polymeric backbone can contain metal atoms which replace the silicon, and the organic compound can contain, as a reactive group, an epoxy, an amino, a carboxyl, a carbonyl, a vinyl or a methacrylate group. Furthermore, a joint-forming polymeric coating can be spread on the previously obtained, tight glassy layer of coating to close the manufactured package. Products, to which the paper or the board coated according to the invention can be applied, include milk and juice containers or similar packages of liquid foodstuffs, bag-type foodstuff packages, heat-sealed, peelable covers of containers and boxes, and microwave and conventional oven trays.

SUMMARY

The following summary is intended to introduce the reader to various aspects of the specification, but not to define or delimit any invention.

According to some aspects, a package comprises a container including a plant based first structural layer having a first inner surface and an opposed first outer surface, and a pre-formed polymeric first liner layer secured to the first structural layer and lining at least a portion of the first inner surface or the first outer surface. A lid is removably securable to the container and comprises a plant based second structural layer having a second inner surface and an opposed second outer surface, and a pre-formed polymeric second liner layer secured to the second structural layer and lining at least a portion of the second inner surface or the second outer surface.

In some examples, the first liner layer may be removably secured to the first structural layer, and the second liner layer may be removably secured to the second structural layer. The first and second liner layers may be secured to the first and second structural layers, respectively, with an adhesive. The first and second liner layers may alternatively or additionally be mechanically secured to the first and second structural layers, respectively.

In some examples, the first liner layer may line the first inner surface. The first structural layer may comprise a base and a first sidewall extending upwardly from the base, and may define a first opening. The first sidewall may have an upper end defining the first opening, and comprising an upper end face. The first liner layer may comprise an overlap portion that includes a radially extending lip extending across the upper end face, and a downwardly extending first skirt extending along a portion of the first outer surface.

In some examples, a separately formed first collar is provided for threadably securing the lid to the container. The first collar may be received around the overlap portion of the first liner layer, and may have a threaded outer circumference for mating with the lid.

In some examples, the first skirt may have a plurality of apertures extending through a wall thickness thereof, and the first collar may be adhered to the first structural layer via the apertures.

In some examples, the second liner layer may line the second inner surface. The second structural layer may comprise a top wall and a downwardly extending second side wall, and may define a second opening. The second liner layer may comprise a downwardly extending second skirt. A separately formed second collar may be provided for threadably securing the lid to the container. The second collar may be received in the second skirt, and may have a threaded inner circumference for mating with the container. The second skirt may have a plurality of apertures extending through a wall thickness thereof, and the second collar may be adhered to the second structural layer via the apertures In some examples, the first structural layer may include a first side piece, and a separately formed second side piece. Each side piece may comprise a base portion and a sidewall portion. Each sidewall portion may comprise a pair of generally vertically extending end faces, and a pair of radially extending structural layer flanges adjacent the end faces. The first liner layer may comprise a pair of liner layer flanges extending radially outwardly therefrom. Each liner layer flange may be sandwiched between one of the structural layer flanges of the first side piece and one of the structural layer flanges of the second side piece. The liner layer flanges may comprise a plurality of apertures extending through a wall thickness thereof, and the structural layer flanges of the first side piece may be adhered to the structural layer flanges of the second side piece via the apertures.

In some examples, the first liner layer may comprise a tongue, and the first structural layer may comprise a groove, and the tongue may be received in the groove and be frictionally secured therein.

In some examples, at least one of the first liner layer and the second liner layer may be fabricated from silicone.

In some examples, at least one of the first structural layer and the second structural layer may be fabricated from bagasse.

According to some aspects, a container comprises a plant based structural layer having an inner surface and an opposed outer surface. A pre-formed polymeric liner layer is secured to the plant based structural layer and lines at least one of the inner surface and the outer surface.

In some examples, the structural layer may comprise a pair of flexible panels. Each panel may have a pair of opposed side edges, and the pair of panels may be joined to each other along the side edges. The container may reconfigurable between a flattened configuration in which the panels are flattened to provide a substantially flat container, and an expanded configuration in which the panels are flexed outwardly to define an interior volume of the container therebetween.

In some examples, the container may further comprise at least one end cap to retain the container in the expanded configuration.

In some examples, the liner layer may be removably secured to the structural layer.

In some examples, the container may further comprise a liquid-permeable filter media positioned interior of the structural layer. The pre-formed polymeric liner layer may comprise a first liner layer lining the outer surface, and a second liner layer secured to at least one of the structural layer and the first inner layer and sealing the filter media within a volume defined by the inner surface of the structural layer and the second liner layer.

In some examples, the container may further comprise a thread secured at a first end to the filter media. A second end of the thread may be graspable by a user. The filter media may be separable from the structural layer by pulling on the second end while restraining the structural layer.

In some examples, the first end of the thread is secured about a perimeter of an upper end of the filter media.

In some examples, the first end of the thread is also secured about a perimeter of the second liner layer.

In some examples, the second liner layer, the filter media, and the thread are compostable.

In some examples, the liner layer may be secured to the structural layer with an adhesive. In some examples, the liner layer may be mechanically secured to the structural layer.

In some examples, the liner layer may be fabricated from silicone. In some examples, the structural layer may be fabricated from bagasse.

According to some aspects, a process for making a container comprises a) forming a structural layer of the container from a plant based material; b) separately forming a liner layer of the container from a polymer, to yield a pre-formed liner layer; c) mating the pre-formed liner layer to the structural layer, so that the pre-formed liner layer lines at least a portion of the structural layer; and c) securing the pre-formed liner layer to the structural layer.

In some examples, step c) may comprise inserting the pre-formed liner layer into the structure layer. In some examples, step c) may comprise inserting the structural layer into the pre-formed liner layer.

In some examples, step d) may comprise removably securing the pre-formed liner layer to the structural layer.

In some examples, the process may further comprise: e) removing the pre-formed liner layer from the structural layer, and recycling each of the pre-formed liner layer and the structural layer.

In some examples, step d) may comprise positioning a portion of the pre-formed liner layer between two portions of the structural layer.

In some examples, the process may further comprise pinching the portion of the pre-formed liner layer between the two portions of the structural layer to frictionally secure the pre-formed liner layer to the structural layer. The portion of the pre-formed liner layer may include apertures extending therethrough, and the process may further comprise adhering the two portions of the structural layer together via the apertures.

In some examples, the process may further comprise securing a threaded collar over the liner layer. Step c) may comprise positioning an overlap portion of the pre-formed liner layer on an outer surface of the structural layer, and step d) may comprise positioning the threaded collar over the overlap portion. The overlap portion may include apertures extending therethrough, and step d) may comprise adhering the threaded collar to the structural layer via the apertures.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

The present application relates to packaging for a variety of materials. Such materials may include, but are not limited to, food, drinks, water, chemicals, cosmetics, soaps, medicines, and detergents. The packaging disclosed herein may in some examples be generally waterproof. In some examples, the interior of the package may be waterproof, in that it may prevent liquids or wet materials from leaking out from the package. Such packages may optionally be used to store liquids, pastes, gels, or other wet materials. However, such packaging may also be used to store generally dry materials. In some examples, the exterior of the package may be waterproof, in that it may prevent or inhibit wet materials from entering the package. For example, such a package may optionally be used to store dry materials, and to prevent such materials from becoming wet. Furthermore, the packaging disclosed herein may in some examples be generally reusable and/or recyclable. Furthermore, the packaging disclosed herein may in some examples be made from materials that are considered generally environmentally friendly, such as plant fibers (e.g. bagasse) and silicone polymers.

In general, examples of the packaging disclosed herein may emulate the desirable properties of plastic packaging by using one or more plant fiber layers or shells to provide structural support and/or rigidity, and one or more polymeric layers (e.g. silicone polymer) to provide a liquid impermeable barrier to contain a liquid within the packaging (and/or to prevent liquid from entering the packaging), and/or to protect the one or more plant fiber layers from exposure to liquids. In this way, the packaging disclosed herein may in some examples be used as a replacement for or as an alternative to plastic containers and packages. For example, the packaging disclosed herein may be used as an alternative to plastic water bottles.

Figure 1:
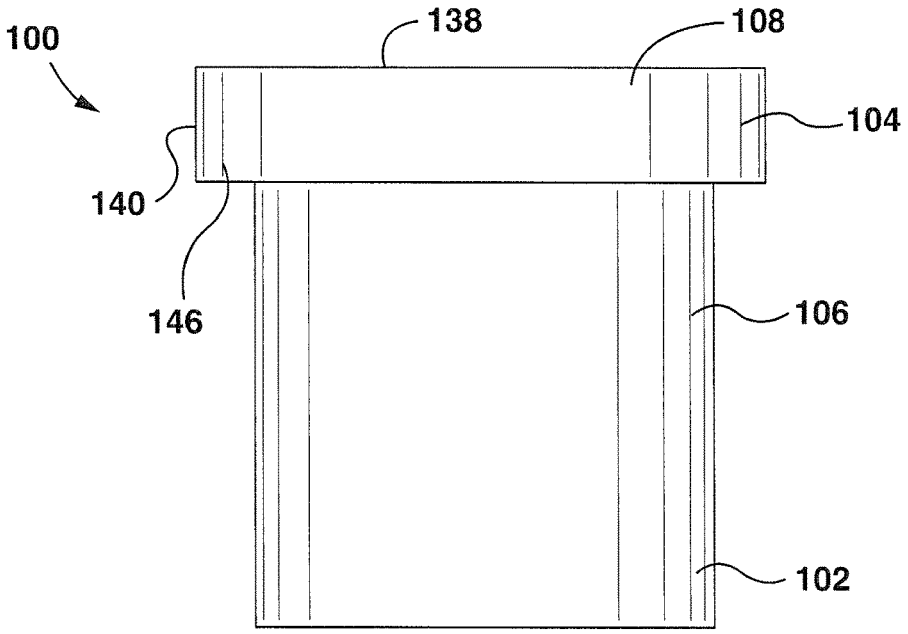
FIG. 1 is a side elevation view of an example package, with a lid of the package secured to a container of the package.
Figure 2:
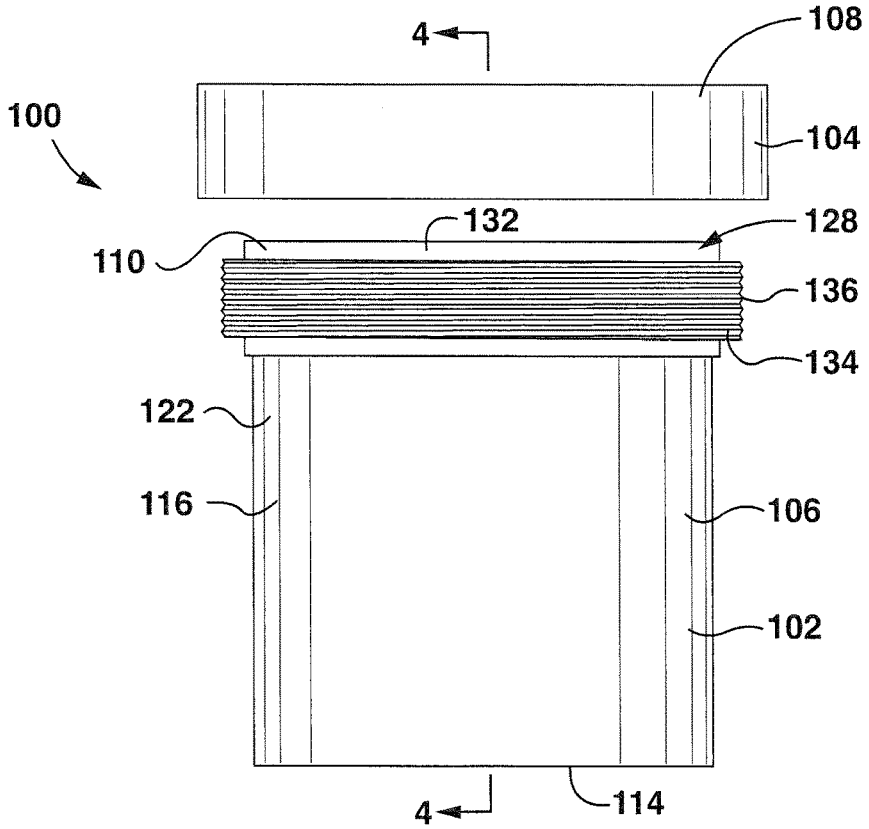
FIG. 2 is a side elevation view of the package of FIG. 1, with the lid removed from the container.

Referring now to FIGS. 1 and 2, an example package 100 is shown. The package is generally in the configuration of a jar, and includes a container 102, and a lid 104 removably secured to the container 102. In the example shown, the lid 104 may be secured to the container by screwing the lid 104 onto the container 102, and may be removed from the container 102 by unscrewing the lid 104 from the container 102, as shown in FIG. 2.

In alternative examples, the lid may be secured to the container in another manner, for example by a snap fit, bayonet mount, or friction fit with the container.

In the example shown, the lid 104 may be re-secured to the container 102 after it has been removed. In alternative examples, the lid and container may be configured such that the lid may generally not be secured back onto the container after it has been removed. For example, the lid may be adhered to the container so that it must be torn to be removed from the container.

Figure 3:
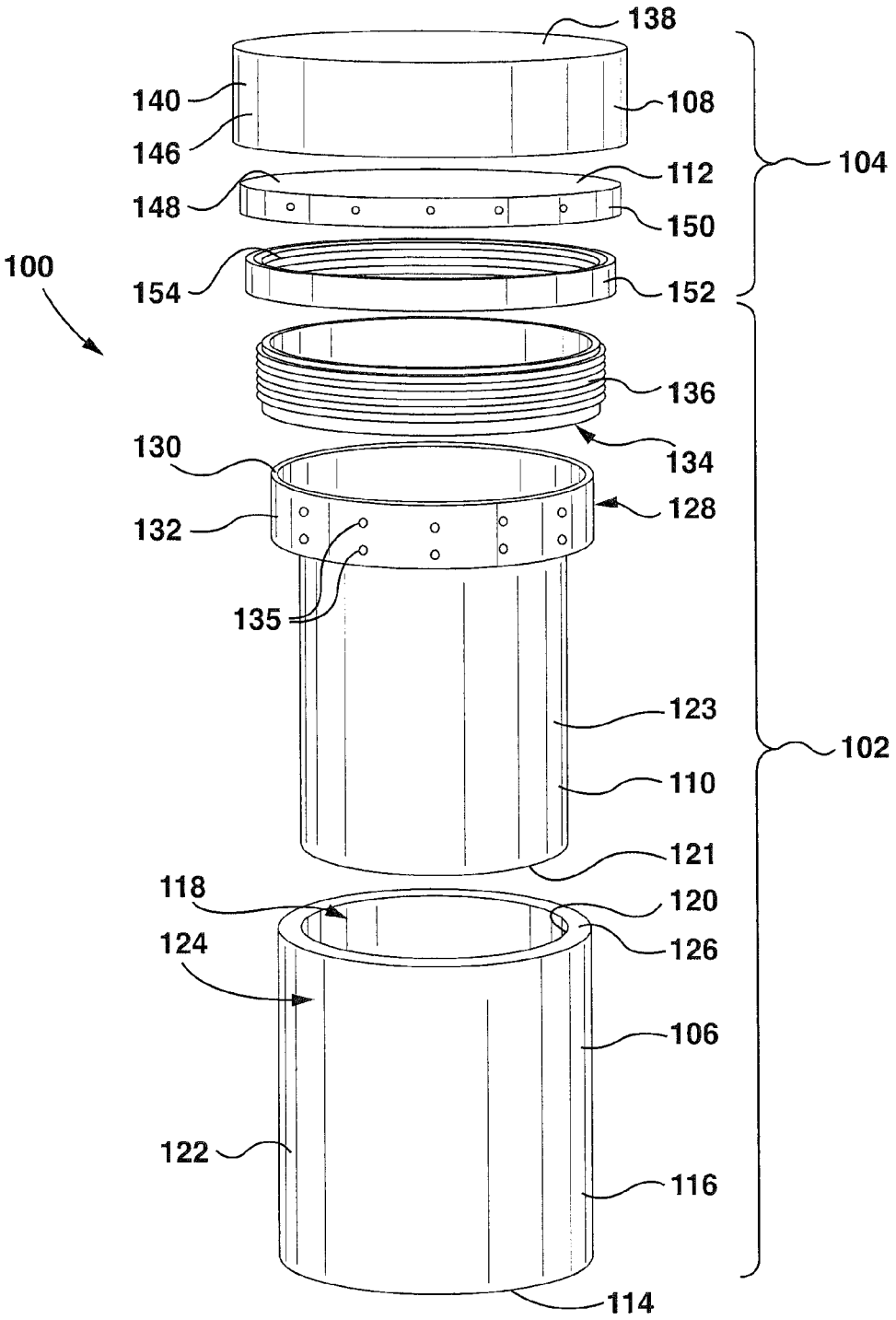
FIG. 3 is an exploded perspective view of the package of FIG. 1.
Figure 4:
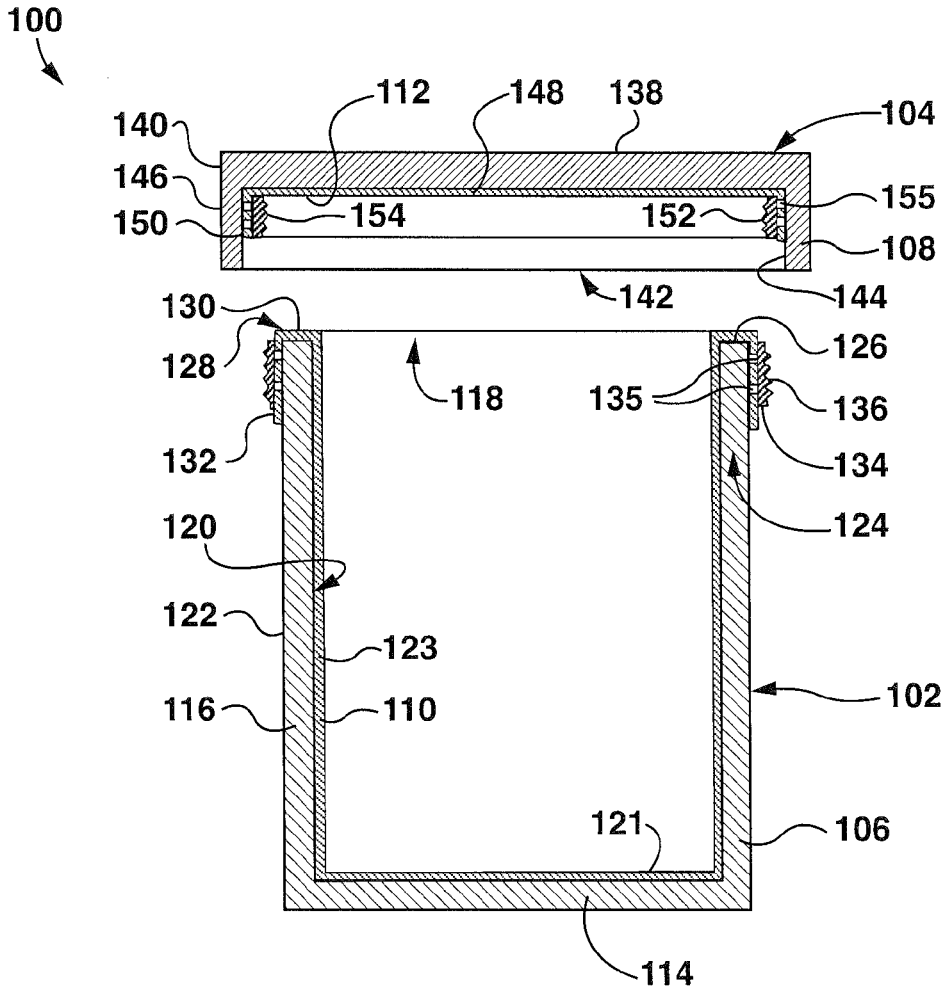
FIG. 4 is a cross-section taken along line 4-4 in FIG. 2.

Referring now to FIGS. 3 and 4, each of the container 102 and the lid 104 include a structural layer 106, 108, respectively, and a liner layer 110, 112, respectively. The liner layers 110, 112 serve to line at least a portion of the structural layers 106, 108, respectively. The structural layer 106 of the container 102 may also be referred to herein as a "first structural layer", and the structural layer 108 of the lid 104 may also be referred to herein as a "second structural layer". The liner layer 110 of the container 102 may also be referred to herein as a "first liner layer", and the liner layer 112 of the lid 104 may also be referred to herein as a "second liner layer".

The structural layers 106, 108 may in some examples be plant based. For example, the structural layers 106, 108 may be made from a paperboard and/or cardboard. The plant material used for the structural layer may be derived from, for example, rice, wheat, wood, cotton, flax, linen, sugarcane, bamboo, kenaf, hemp, cork, coconut, jute, and combinations thereof. For example, the plant material may be wood fiber, cotton fiber, flax fiber, linen fiber, bagasse fiber, bagasse husks, bagasse straw, bamboo fiber, kenaf fiber, hemp fiber, coconut coir, jute fiber, and combinations thereof. In some examples, the plant material may be a waste material, such as rice chaff or husks. In some examples, the plant material may be purpose grown. In some examples, the plant material may be virgin materials. In some examples, the plant materials may be recycled materials. In some examples, non-plant based additives may be included in the structural layer, such as calcium carbonate. In some particular examples, the structural layers 106, 108 may be fabricated from bagasse, and may include bagasse fiber paperboard. Alternatively or additionally, the structural layer may include natural latex.

The structural layers 106, 108 may in some examples include fibers of different coarseness, different refinements, and varying levels of processing.

The structural layers 106, 108 may optionally be formed by molding. The structural layers 106, 108 may have a wall thickness that is selected based on the structural strength required of the package.

The liner layers 110, 112 may in some examples be generally waterproof, antimicrobial, and/or inert. The liner layers 110, 112 may also in some examples be oxygen impermeable, and impermeable to other gases. In some examples, the liner layers 110, 112 may be polymeric, and in some particular examples are fabricated from a silicone polymer, such as a food grade silicone polymer. Alternatively or additionally, the liner layers 110, 112 may be or may include another polymeric material, such as latex, or a bioplastic such as a plant based polymer. One example of such a bioplastic is a thermoplastic starch polymer. Another example of such a bioplastic is an algae-based plastic. Alternatively or additionally, the liner layers 110, 112 may be or may include a sugar based polymer. Alternatively or additionally, the liner layers 110, 112 may be or may include conventional polymers, such as polyethylene.

The liner layers 110, 112 may be pre-formed. That is, they may be formed into a particular shape (e.g. by molding, or by joining sheets by adhesives, heat, or sonic welding) and then subsequently mated to the structural layers 106, 108. For example, the pre-formed liner layers 110, 112 may be inserted into and secured to the structural layers 106, 108, respectively. In alternative examples, liner layers may be formed into a particular shape, and then the structural layers may be inserted into the liner layers. These examples, wherein the liner layers are pre-formed, are in contrast to processes wherein a polymeric layer is formed directly on a paperboard layer by a coating process, and the term "pre-formed" excludes such processes.

As used herein, the term "secured" indicates that the liner layers 110, 112 are held together with the structural layers 106, 108, respectively, in such a manner so that the liner layers 110, 112 do not come apart from the structural layers 106, 108 during use of the packaging to store and dispense a material. That is, if the container 102 is inverted to dispense the contents thereof, the liner layer 110 will not fall out of the structural layer 106 under the force of gravity. Similarly, if the lid 104 is inverted, the liner layer 112 will not fall out of the structural layer 108 under the force of gravity. The term "removably secured" indicates that the liner layers 110, 112 are held together to the structural layers 106, 108, respectively, in such a manner so that the liner layers 110, 112 do not come apart from the structural layers 106, 108 during use of the packaging to store and dispense a material; however, the liner layers 110, 112 may be separated from the structural layers 106, 108 if additional force is applied, such as if the package is crushed or if the liner layers 110, 112 are torn from the structural layers 106, 108.

The liner layers 110, 112 may optionally be relatively thin. Thinner liner layers may be advantageous in order to minimize the amount of silicon used in the package. For example, the liner layers 110, 112 may have a wall thickness of as low as 0.025 mm. In some particular examples, the liner layers 110, 112 may have a wall thickness of between about 0.025 mm and about 0.127 mm. In further particular examples, the liner layers 110, 112 may have a wall thickness of between about 0.025 mm and about 0.05 mm.

The use of pre-formed liner layers 110, 112 may in some examples be advantageous, because this may allow for the liner layers 110, 112 to be removably secured to the structural layers 106, 108 respectively. This may allow for the liner layers 110, 112 to be removed from the structural layers 106, 108, respectively, for recycling or composting. For example, after the package 100 has been used (e.g. after a single use or multiple uses), the liner layers 110, 112 may be removed from the structural layers 106, 108, and each may be separately recycled, or the structural layers 106, 108 may be composted. The liner layers 110, 112 may be removed from the structural layers 106, 108 manually, or in an automated process. For example, an end-user (e.g. a consumer of a food product in the package) may manually separate the liner layers 110, 112 from the structural layers and place each in a recycling bin or compost bin. Alternatively, the liner layers 110, 112 may be separated from the structural layers 106, 108 at a recycling facility, either manually or by machine. In either case, in order to facilitate the removal of the liner layers 110, 112 from the structural layers 106, 108, the package 100 may optionally first be crushed prior to removal of the liner layers 110, 112.

Referring still to FIGS. 3 and 4, the configuration of the container 102 will be described in further detail.

In the example shown, the container 102 is generally cylindrical, and the structural layer 106 of the container 102 includes a circular base 114 and a generally cylindrical sidewall 116 (also referred to as a "first sidewall") extending upwardly from the base 114. The structural layer 106 further defines an opening 118 (also referred to as a "first opening").

In alternative examples, the container 102 may be of another shape, for example generally cubic. In such an example, the sidewall 116 may include four generally square sidewall portions. In other examples, the container 102 may be of a non-fixed shape.

The structural layer 106 has an inner surface 120 (also referred to as a "first inner surface") and an opposed outer surface 122 (also referred to as a "first outer surface"). In the example shown, the liner layer 110 is secured to the structural layer 106 and lines the inner surface 120. Specifically, the liner layer 110 includes a generally circular bottom panel 121 that lines the base 114, and a generally cylindrical side panel 123 that lines the sidewall 116. In the example shown, the liner layer 110 is one single integral piece.

In the example shown, the liner layer 110 lines the entirety of the inner surface 120. In alternative examples, the liner layer 110 may line only a portion of the inner surface 120.

As mentioned above, in the example shown, the liner layer 110 is removably secured to the structural layer 106, as will be described in further detail below. In general, liner layers may be removably secured to structural layers for example with an adhesive, and/or may be mechanically removably secured to the structural layers.

As an example of mechanical securement, a liner layer may be positioned between multiple structural layers (or multiple portions of a structural layer) to create a frictional hold on the liner layer entrapped between the structural layers. As another example of mechanical securement, the structural layer at the rim of a container opening may be rolled onto or along with a liner layer to secure the liner layer within the rolled structural layer. In some examples, some or all of the surface of the liner layer and/or the folded fiber layers may be shaped and/or textured (e.g. provided with teeth, ridges or the like) to increase the frictional grip between the secured layers. Examples of mechanical securement are described in further detail below.

In the case of an adhesive, a liner layer may be removed from a structural layer for example by tearing the liner layer away from the structural layer. In case of mechanical securing, a liner layer may be removed from a structural layer for example by tearing the liner layer away from the structural layer, or by removing or undoing the mechanical securing mechanism.

In the example shown, the sidewall 116 has an upper end 124 that defines the first opening 118, and that includes an upper end face 126. The liner layer 110 includes an overlap portion 128 that includes a radially extending lip 130 that extends across the upper end face 126, and a downwardly extending skirt 132 that extends along a portion of the outer surface 122. The overlap portion 128 forms a pocket that receives the upper end 124 of the sidewall 116, and frictionally grips the sidewall 116.

Furthermore, in the example shown, the container 102 further includes a collar 134 (also referred to as a "first collar"). The collar 134 is received around the overlap portion 128 of the liner layer 110. The skirt 132 has a plurality of apertures 135 extending through its wall thickness. An adhesive is applied to the apertures 135 and is used to secure the collar 134 to the upper end 124 of the sidewall 116, via the apertures 135. More specifically, the adhesive may be applied to the outer surface 122 at upper end 124, to the skirt 132, and/or to the collar 134. The adhesive may generally fill the apertures 135, so that the collar 134 is adhered to the structural layer 106 through the apertures. The collar 134 therefore further secures the liner layer 110 to the structural layer 106.

In the example shown, the collar 134 is threaded. That is, the collar 134 has a threaded outer circumference 136, for mating with the lid 104, as will be described in further detail below.

The collar 134 may be, for example, plant based, as described above with respect to the structural layers 106, 108. For example, the collar 134 may be made from a paperboard or cardboard, may include any of the plant fibers described above, and may be molded.

Referring still to FIGS. 3 and 4, the configuration of the lid 104 will be described in further detail.

In the example shown, the lid 104 is generally cylindrical to match the shape of the container 102, and the structural layer 108 of the lid 104 includes a generally circular top wall 138, and a generally cylindrical downwardly extending sidewall 140 (also referred to as a "second sidewall"). The structural layer 108 further defines an opening 142 (also referred to as a "second opening"). The structural layer 108 includes an inner surface 144 (also referred to as a "second inner surface") and an opposed outer surface 146 (also referred to as a "second outer surface").

In the example shown, the liner layer 112 of the lid 104 is secured to the structural layer 108 and lines a portion of the inner surface 144. More specifically, the liner layer 112 includes a generally circular top panel 148 that lines the top wall 138, and a downwardly extending skirt 150 that lines a portion of the sidewall 140. In alternative examples, the liner layer 112 may line the entire inner surface 144.

As mentioned above, the liner layer 112 may removably secured to the structural layer 108. For example, as mentioned above, liner layers may be removably secured to structural layers with an adhesive, and/or may be mechanically removably secured to structural layers. In the case of an adhesive, liner layers may be removed from structural layers for example by tearing the liner layer away from the structural layer. In case of mechanical securing, liner layers may be removed from structural layers for example by tearing the liner layer away from the structural layer, or by removing or undoing the mechanical securing mechanism.

In the example shown, the lid 104 further includes a second collar 152. The second collar 152 is received in the skirt 150 of the liner layer 112. The skirt 150 has a plurality of apertures 155 extending through its wall thickness. An adhesive is applied to the apertures 155 and is used to secure the second collar 152 to the sidewall 140 of the structural layer 108 via the apertures 155. The adhering of the second collar 152 to the sidewall 140 secures the liner layer 112 to the structural layer 108.

In the example shown, the second collar 152 is threaded. That is, the second collar 152 has a threaded inner circumference 154. The lid 104 may be secured to the container 102 by engaging the threads of the second collar 152 with the threads of the first collar 134, and tightening. When tightened, the top panel 148 of the liner layer 112 of the lid 104 may be pressed and sealed against the lip 130 of the liner layer 110 of the container 102, to form a generally watertight seal between the lid 104 and the container 102.

In alternative examples, the collars 134, 152 may serve only to secure the liner layers 110, 112 to the structural layers 106, 108, respectively, and may not necessarily be threaded for securing the lid 104 to the container 102. In some such examples, an alternative mechanism may be provided for securing the lid 104 to the container 102. For example, the lid 104 may be adhered to the container 102. In further alternative examples, the collars 134, 152 may serve only to secure the lid 104 to the container 102, and may not necessarily aid in securing the liner layers 110, 112 to the structural layers 106, 108. In some such examples, the liner layers 110, 112 may be secured to the structural layers 106, 108, respectively, in another manner, such as by friction. In yet further alternative examples the collars 134, 152 may not be threaded, and may secure the lid 104 to the container 102 in another manner. For example, the collars 134, 152 may be configured to secure the lid 104 to the container 102 by a snap-fit, a friction fit, or a bayonet mount.

Referring now to FIGS. 5A to 6B, an alternative example of a container 502 is shown. In FIGS. 5A to 6B, like features as in FIGS. 1 to 4 are referred to with like reference numerals, with the first digit incremented by 4.

Figure 5A:
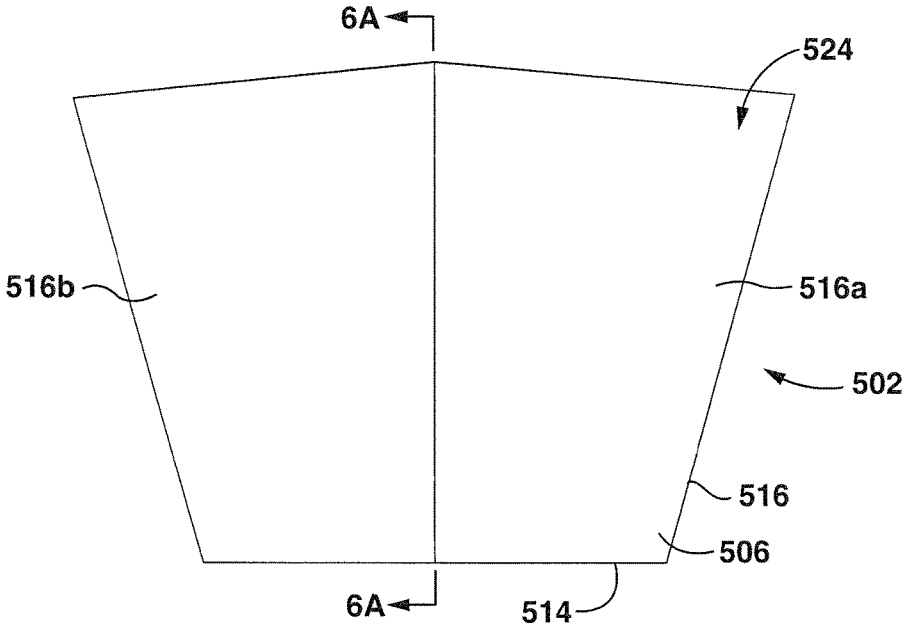
FIG. 5A is a side elevation view of another example container, in a partially unassembled configuration.
Figure 5B:
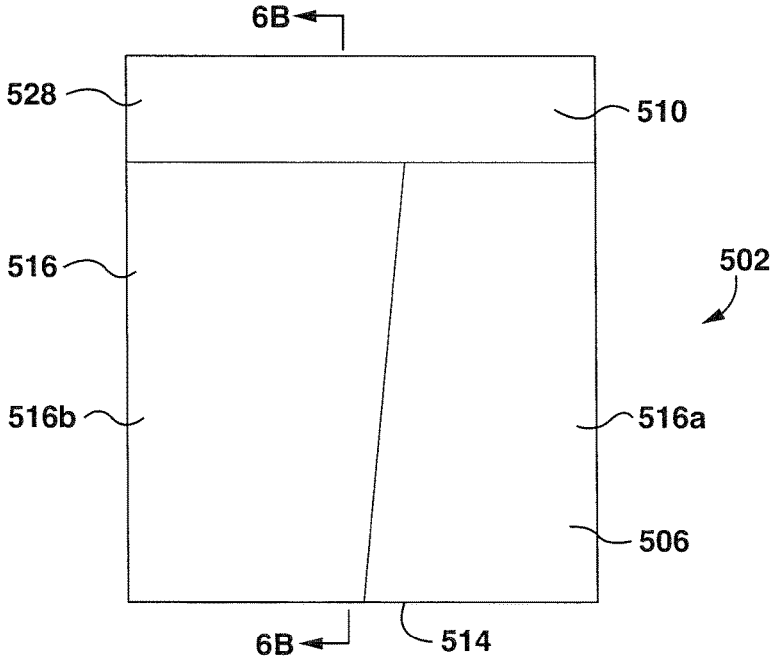
FIG. 5B is a side elevation view of the container of FIG. 5A, in an assembled configuration.
Figure 6A:
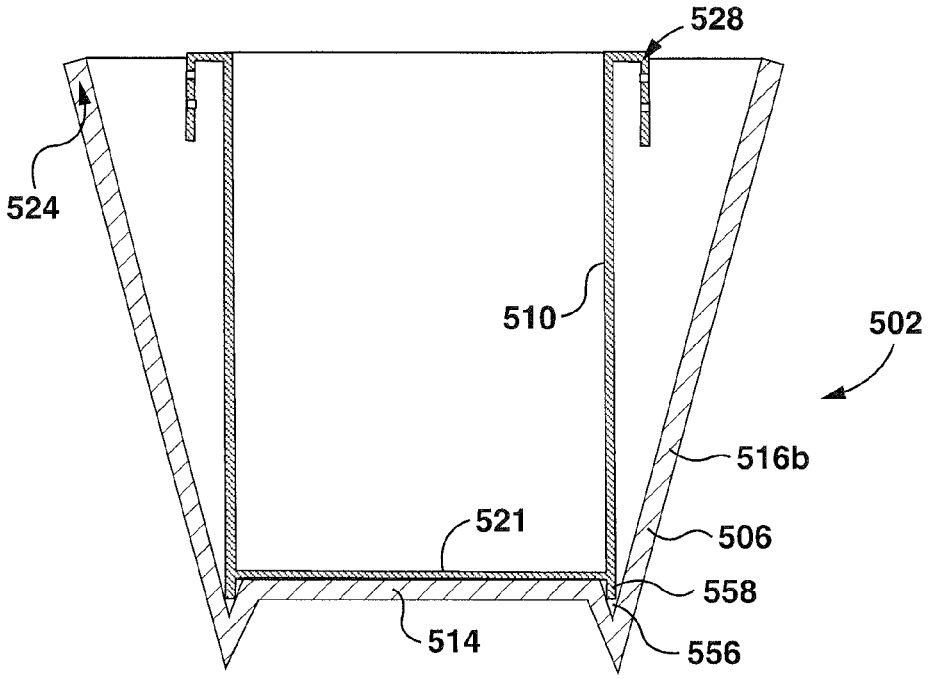
FIG. 6A is a cross-section taken along line 6A-6A in FIG. 5A.
Figure 6B:
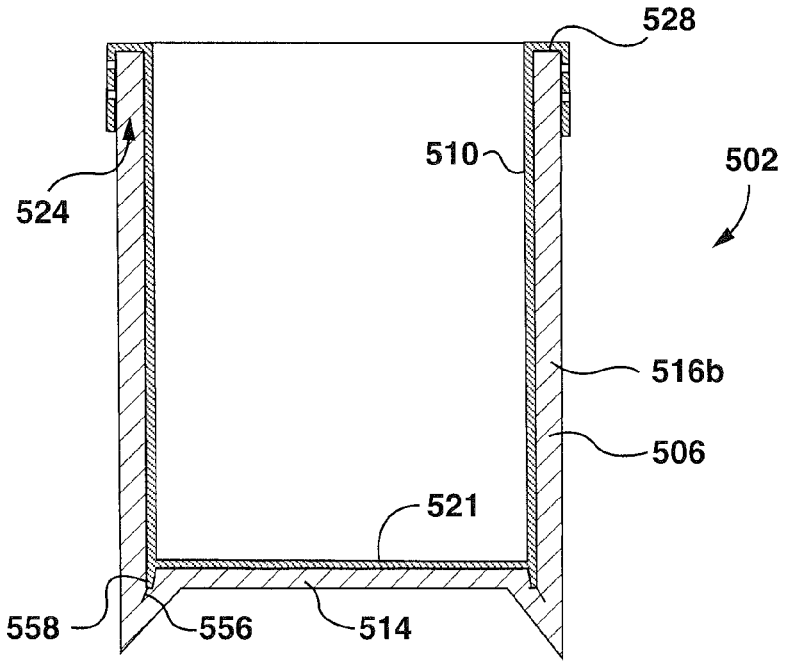
FIG. 6B is a cross-section taken along line 6B-6B in FIG. 6B.
Figure 7:
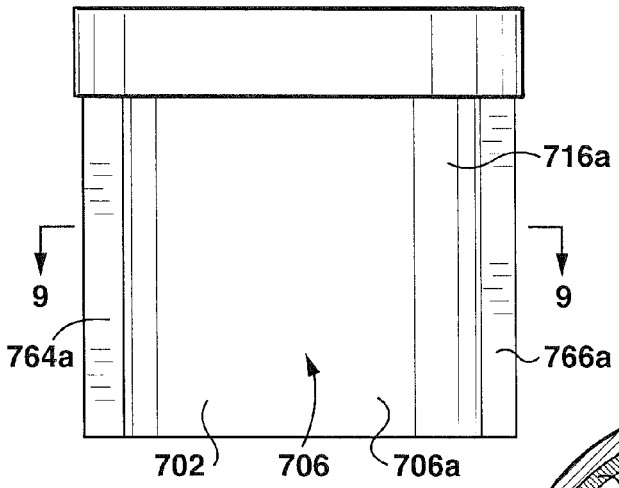
FIG. 7 is a side elevation view of another example package, with a lid of the package secured to a container of the package.
Figure 9:
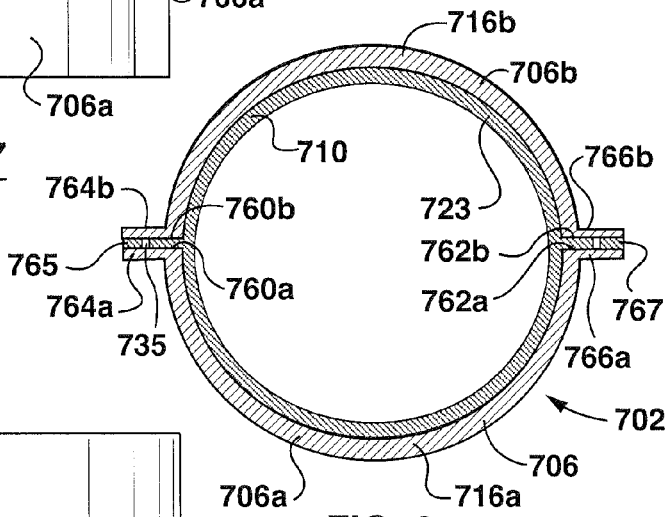
FIG. 9 is a cross-section taken along line 9-9 in FIG. 7.
Figure 8:
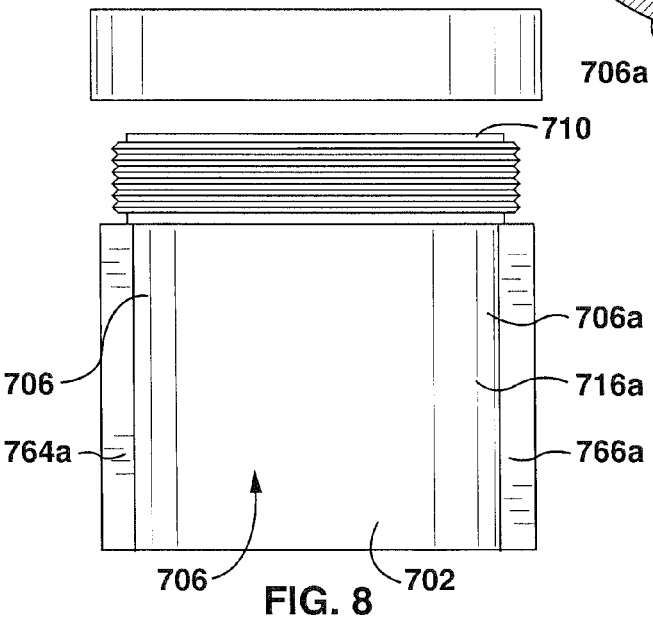
FIG. 8 is a side elevation view of the package of FIG. 7, with the lid removed from the container.
Figure 10:
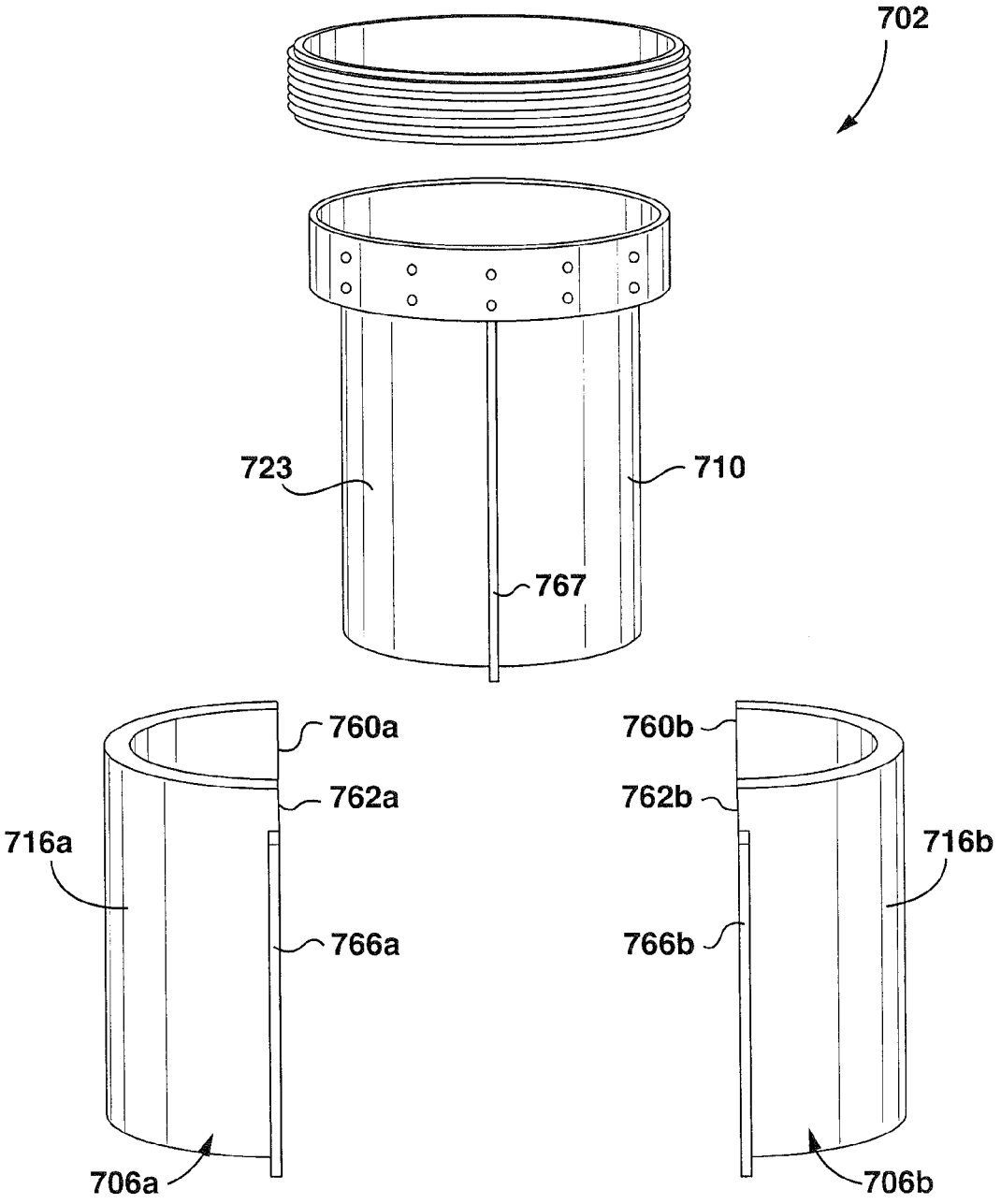
FIG. 10 is an exploded view of the container of FIG. 7.

In this example, an additional securing mechanism is provided to secure the liner layer 510 of the container 502 to the structural layer 506 of the container 502. More specifically, the sidewall 516 of the structural layer is formed in two pieces, 516*a*, 516*b*, that may be folded towards each other, as shown in FIGS. 5B and 6B, and away from each other, as shown in FIGS. 5A and 6A. The junction between the sidewall pieces 516*a*, 516*b*, respectively, and the base 514 includes a groove 556. When the sidewall pieces 516*a*, 516*b* are folded away from each other, the groove 556 is generally open, and when the sidewall pieces 516*a*, 516*b* are folded towards each other, the groove 556 is generally closed.

The liner layer 510 includes a tongue 558, extending downwardly from the perimeter of the bottom panel 521. During manufacturing of the container 502, the tongue 558 may be positioned in the groove 556 when the groove 556 is open. The sidewall pieces 516*a*, 516*b* may then be folded towards each other, to close the groove 556 and pinch and frictionally secure the tongue 558 in the groove 556. The sidewall pieces 516*a*, 516*b* may then be secured together, for example with the use of an adhesive. The overlap portion 528 of liner layer 510 may then be positioned over and secured to the upper end 524 of the structural layer 506, as described above.

In the example of FIGS. 5A to 6B, the tongue 558 may optionally include apertures (not shown), so that the opposed surfaces of the groove 556 can be adhered together via the apertures.

In the example of FIGS. 5A to 6B, the container 502 may optionally include a collar (not shown) as described above with respect to FIGS. 1 to 4.

Referring now to FIGS. 7 to 10, another alternative example of a container 702 is shown. In FIGS. 7 to 10, like features as in FIGS. 1 to 4 are referred to with like reference numerals, with the first digit incremented by 6.

In the example shown, the structural layer 706 of the container 702 is formed in two separate pieces, including a first side piece 706*a*, and a second side piece 706*b*. Each sidepiece 706*a*, 706*b*, includes a semi-circular base portion (not shown), and a semi-cylindrical sidewall portion 716*a*, 716*b*, respectively.

In the example shown, the first sidewall portion 716*a* includes a pair of generally vertically extending end faces 760*a*, 762*a*, and a pair of radially extending flanges 764*a*, 766*a* (also referred to as "structural layer flanges") adjacent the end faces 760*a*, 762*a*. Similarly, the second sidewall portion 716*b* includes a pair of generally vertically extending end faces 760*b*, 762*b*, and a pair of radially extending flanges 764*b*, 766*b* (also referred to as "structural layer flanges") adjacent the end faces 760*b*, 762*b*.

The liner layer 710 includes a pair of flanges 765, 767 (also referred to as "liner layer flanges") extending radially outwardly from the cylindrical side panel 723. The liner layer flanges 765, 767 include a plurality of apertures 735 extending through a wall thickness thereof.

Each liner layer flange 765, 767 is sandwiched between a flange of the first side piece 706*a* and the second side piece 706*b*. Specifically, the flange 765 is sandwiched between the flanges 764*a* and 764*b*, and the flange 767 is sandwiched between the flanges 766*a*, 766*b*. The flanges 764*a* and 764*b* are adhered together via the apertures 735 in the flange 765, and the flanges 766*a* and 766*b* are adhered together via the apertures in the flange 767.

Figure 11:
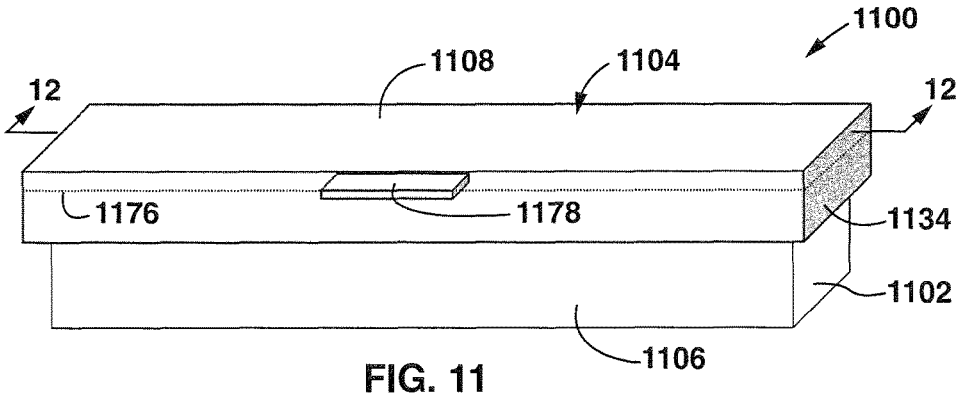
FIG. 11 is a perspective view of another example package.
Figure 13:
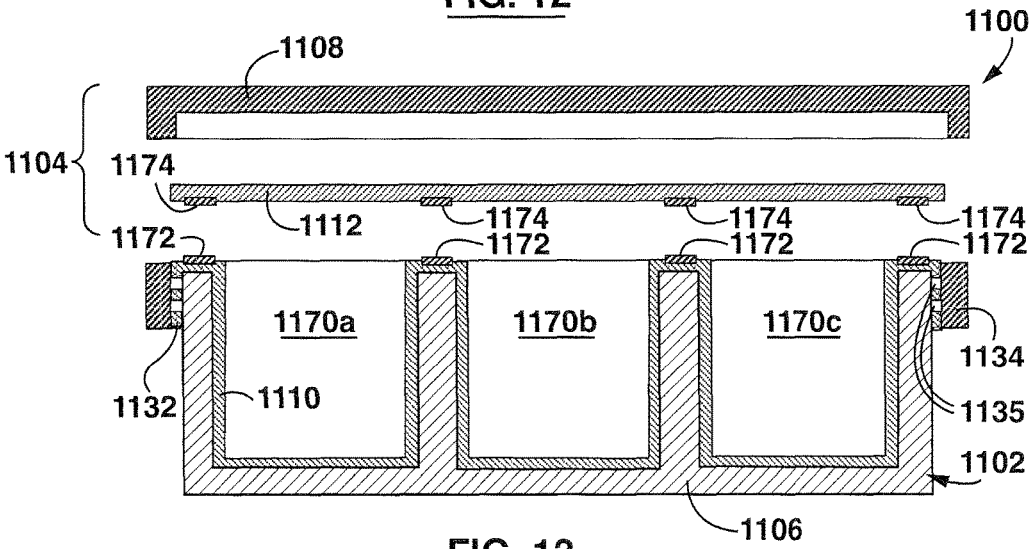
FIG. 13 is the cross-section of FIG. 12, with a structural layer of the lid and a liner layer of the lid removed from the container.

Referring now to FIGS. 11 and 13, a further alternate example of a package 1100 is shown. In FIGS. 11 and 13, like features as in FIGS. 1 to 4 are referred to with like reference numerals, with the first digit incremented by 10.

Figure 12:
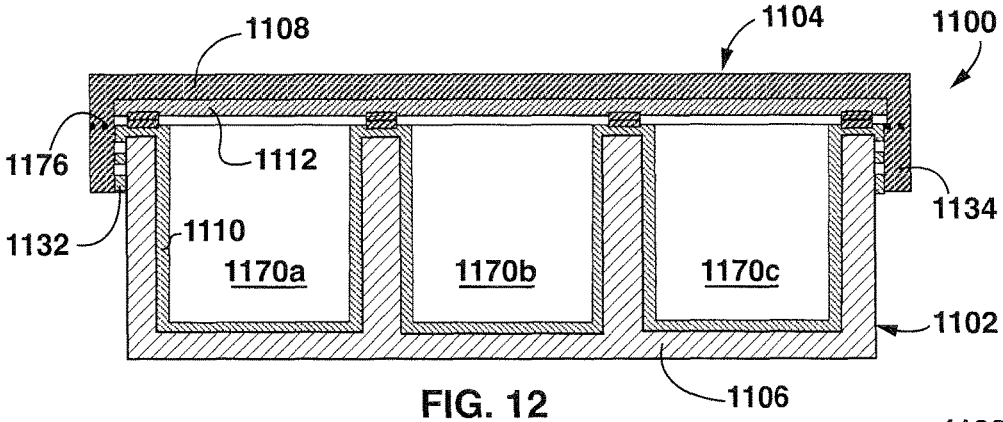
FIG. 12 is a cross-section taken along line 12-12 in FIG. 11.

In the example shown in FIGS. 11 to 13, the container 1102 and lid 1104 are generally rectangular, and the container includes a plurality of compartments 1170*a*, 1170*b*, 1170*c*. Such a container may be useful, for example, for pre-prepared meals, such as pre-prepared frozen meals or pre-prepared microwave meals.

Furthermore, in this example, the container 1102 and lid 1104 are configured to be opened only a single time, and are not configured to be readily re-sealed back together. Specifically, the liner layer 1110 of the container 1102 and the liner layer 1112 of the lid 1104 each have a strip 1172, 1174 (labeled in FIG. 13), respectively, molded therein. The strips 1172, 1174 may be, for example, foil strips or paper strips. The strips 1172, 1174 extend around the perimeter of the container 1102, and between the compartments 1170*a-c*, and are positioned to contact each other when the lid 1104 is positioned on the container 1102. The strips 1172 may be adhered to the strips 1174 with an adhesive, for example a thermal adhesive.

In the example shown, the support layer 1108 of the lid 1104 includes an integral collar 1134. The integral collar 1134 extends downwardly over the skirt 1132 of the liner layer 1110 of the container 1102, and is adhered to the support layer 1106 of the container 1102 via apertures 1135 in the skirt 1132.

In one or more alternative examples, a support layer 1108 may not be provided, and liner layer 1112 may be adhered to container 1102. Such a container may be characterized as a blister pack, in which compartments 1170*a*, 1170*b*, 1170*c* may be opened separately by piercing or otherwise removing the portion of liner layer 1112 overlying the compartment to be opened. In some examples, liner layer 1112 may be translucent or transparent (e.g. a transparent silicone layer) to allow the contents of compartments 1170*a*, 1170*b*, 1170*c* to be viewed without opening the compartments.

In the example shown, the remainder of the support layer 1108 is separable from the collar 1134. Particularly, a perforated line 1176 is formed between the collar 1134 and the remainder of the support layer 1108, so that the remainder of the support layer 1108 may be torn from the collar 1134. The remainder of the support layer 1108 may include a tab or handle 1178, to aid in tearing.

In some examples, in order to open the package 1100, the user may first tear the remainder of the support layer 1108 off of the container 1102, by grasping the handle 1178 and pulling, to cause the support layer 1108 to tear along the perforated line 1176 and lift off of the container 1102. This leaves the collar 1134 in place on the container 1102.

The user may then grasp the liner layer 1112 of the lid 1104 (which may also optionally be provided with a handle), and pull it away from the container 1102. This pulling may cause the strips 1172, 1174 to separate from each other, and open the package 1100.

The package 1100 of FIGS. 11 to 13 may optionally be used in order to preserve food. For example, the pre-formed liner layer 1110 of the container 1102 may be filled with food prior to being inserted in the support layer 1106. In some examples, particularly where the liner layer 1110 is relatively thin and unable to hold its shape when filled with food, a carrier may be used to support the liner layer 1110. For example, the liner layer 1110 may be nested in a stainless steel tray having the same shape as the liner layer 1110. The filled liner layer 1110 may then be sealed with the pre-formed liner layer 112 of the lid 1104. The filled and sealed liner layers 1110, 1112 may then be processed according to traditional canning methods to preserve the contents. For example, the filled and sealed liner layers 110, 112 may be heated. The liner layers 1110, 1112 may then be inserted into and assembled to the support layer 1106 of the container 1102, and the support layer 1108 of the lid 1104 may be mounted to the container 1102 and adhered thereto.

The package 1100 of FIGS. 11 to 13 may be modified to include another number of compartments. For example, the package may include a single compartment only. The single compartment may be used, for example, to store and preserve food (e.g. soup), as described above.

Figure 14:
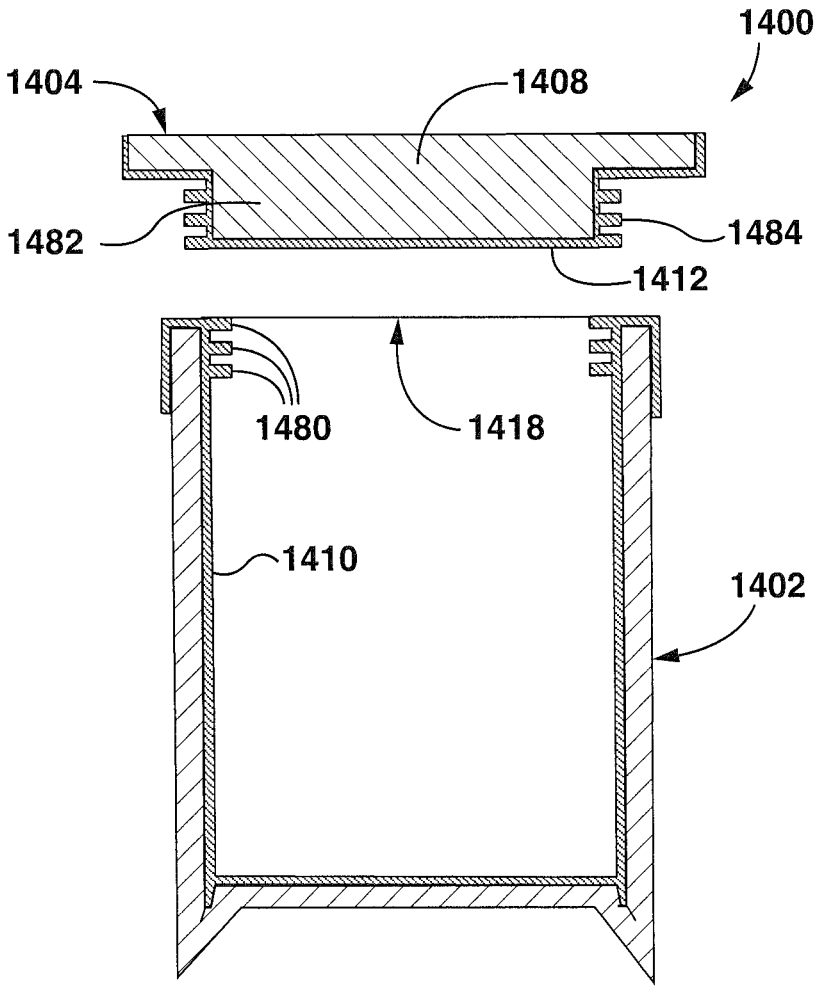
FIG. 14 is a cross-section showing an alternative package.

Referring now to FIG. 14, a further alternate example of a package 1400 is shown. In FIG. 14, like features as in FIGS. 1 to 4 are referred to with like reference numerals, with the first digit incremented by 13.

In the package 1400, the lid 1404 is secured to the container 1402 by a friction fit. The liner layer 1410 includes a series of radially inwardly extending flanges 1480. The structural layer 1408 of the lid 1404 includes a downwardly extending plug 1482, and the liner layer 1412 of the lid 1404 lines the plug 1482. The liner layer 1412 of the lid 1404 includes a plurality of radially outwardly extending flanges 1484 extending around the plug 1482. In use, the plug 1482 may be pressed into the opening 1418, so that the flanges 1484 of the lid 1404 snap past the flanges of the container 1402. When the plug 1482 is fully pressed into the opening 1418, the flanges 1484 of the lid may be positioned between the flanges 1480 of the container. This engagement of the flanges 1480, 1484, as well as the relatively snug fit of the plug 1482 into the opening 1418, may seal the lid 1404 to the container 1402.

In the example shown, the liner layer 1412 of the lid 1404 is secured to the structural layer 1408 of the lid by an adhesive. However, in alternative examples, the liner layer 1412 may be secured to the structural layer 1408 of the lid by an adhesive in another manner, such as with a collar (not shown).

Referring now to FIGS. 15A to 15E, an alternative example of a container 1502 is shown. In FIGS. 15A to 15E, like features as in FIGS. 1 to 4 are referred to with like reference numerals, with the first digit incremented by 14.

Figure 15A:
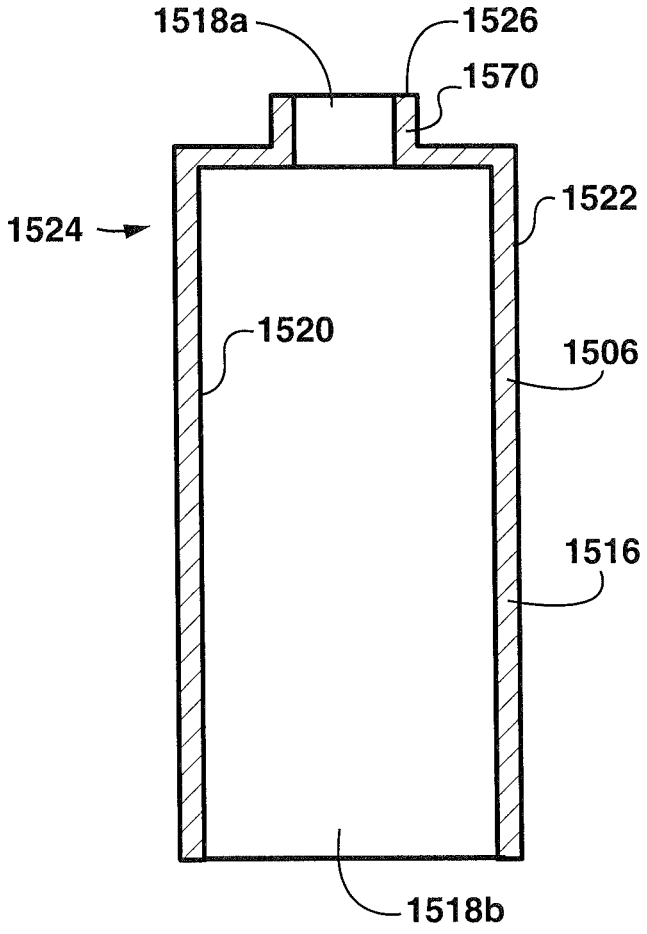
FIG. 15A is a cross-sectional view of a structural layer of another example package.

Referring to FIG. 15A, in this example, the structural layer 1506 includes a sidewall 1516 that defines an opening 1518*b* at a lower end of the sidewall. Sidewall 1516 also includes a neck portion 1570 at the upper end 1524 of the sidewall 1516 that defines an opening 1518*a*.

Figure 15B:
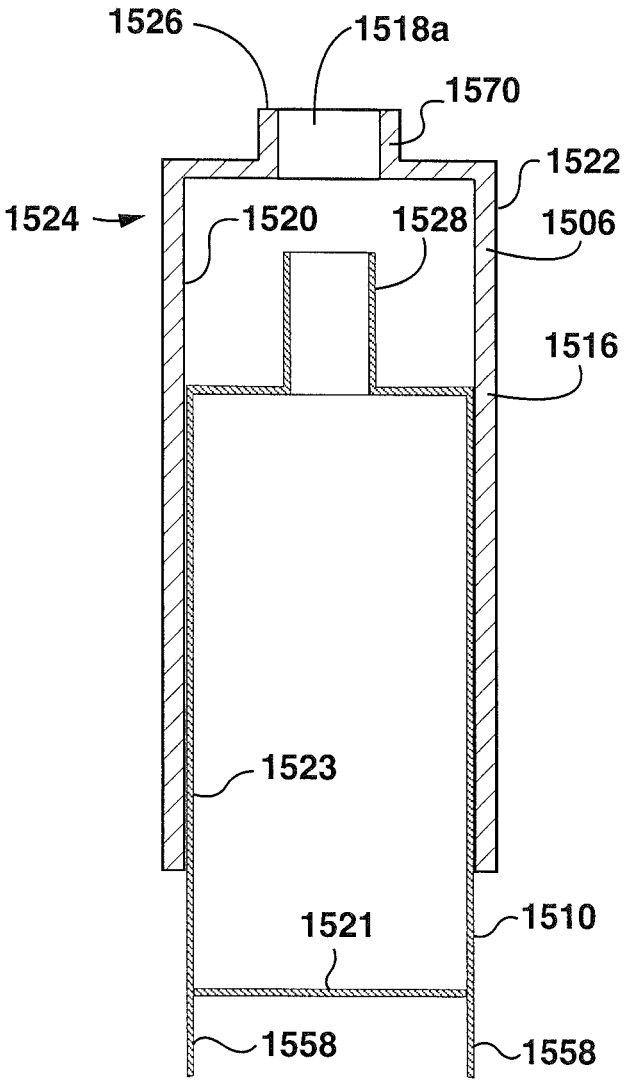
FIG. 15B is a cross-sectional view of the structural layer of FIG. 15A, with a liner layer positioned partially interior of the structural layer.

Referring to FIG. 15B, in the example shown, container 1502 includes a liner layer 1510 dimensioned to be inserted into and to line the inner surface 1520 of the structural layer 1506. Liner layer 1510 includes a tongue 1558, extending downwardly from the perimeter of its bottom panel 1521. Liner layer 1510 also includes an overlap portion 1528 dimensioned to be inserted through and abut the inner surface of neck portion 1570. As shown in FIG. 15B, during manufacturing of the container 1502, liner layer 1510 can be positioned interior of structural layer 1506 via opening 1518*b*.

Figure 15C:
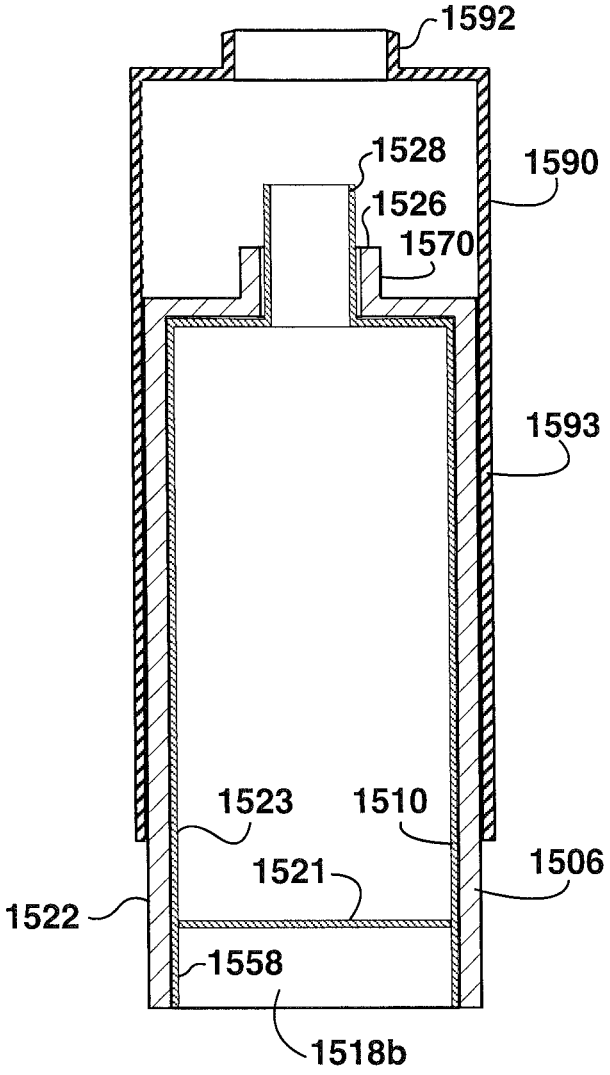
FIG. 15C is a cross-sectional view of the structural layer of FIG. 15A, with the liner layer of FIG. 15B positioned interior of the structural layer, and with an outer layer positioned partially exterior of the structural layer.

Referring to FIG. 15C, in the example shown, container 1502 also includes an outer liner layer 1590 dimensioned to be positioned over and to line the outer surface 1522 of the structural layer 1506. As shown in FIG. 15C, during manufacturing of the container 1502, outer liner layer 1590 can be positioned about structural layer 1506 via an opening defined by the lower portion of the generally cylindrical side panel 1593 of outer layer 1590.

Figure 15D:
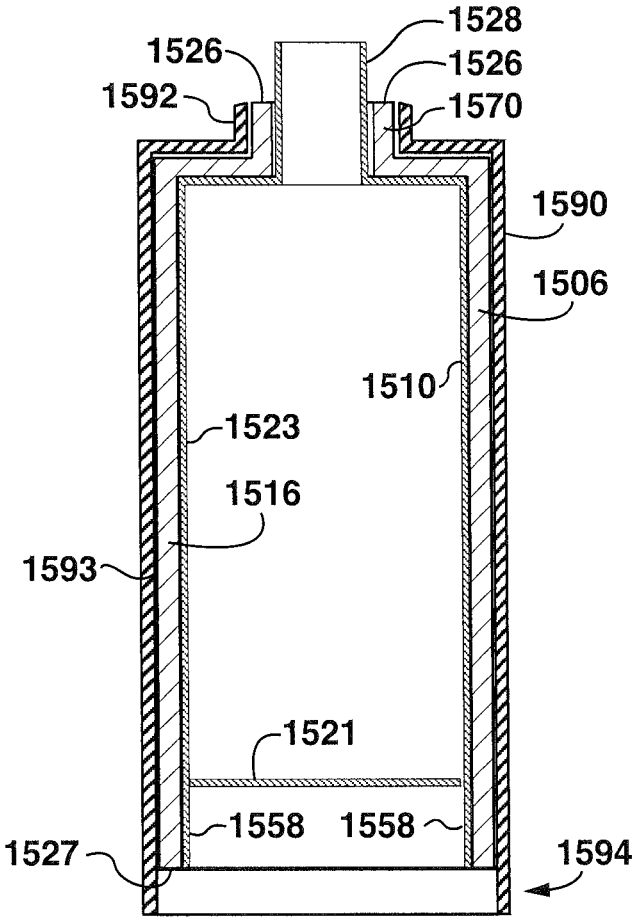
FIG. 15D is a cross-sectional view of the structural layer of FIG. 15A, with the liner layer of FIG. 15B positioned interior of the structural layer, and with the outer layer of FIG. 15C positioned exterior of the structural layer.

In FIG. 15D, liner layer 1510 has been positioned within structural layer 1506, and outer liner layer 1590 has been positioned about structural layer 1506. Layers 1510 and 1590 may be positioned relative to structural layer 1506 in any order, or simultaneously.

Figure 15E:
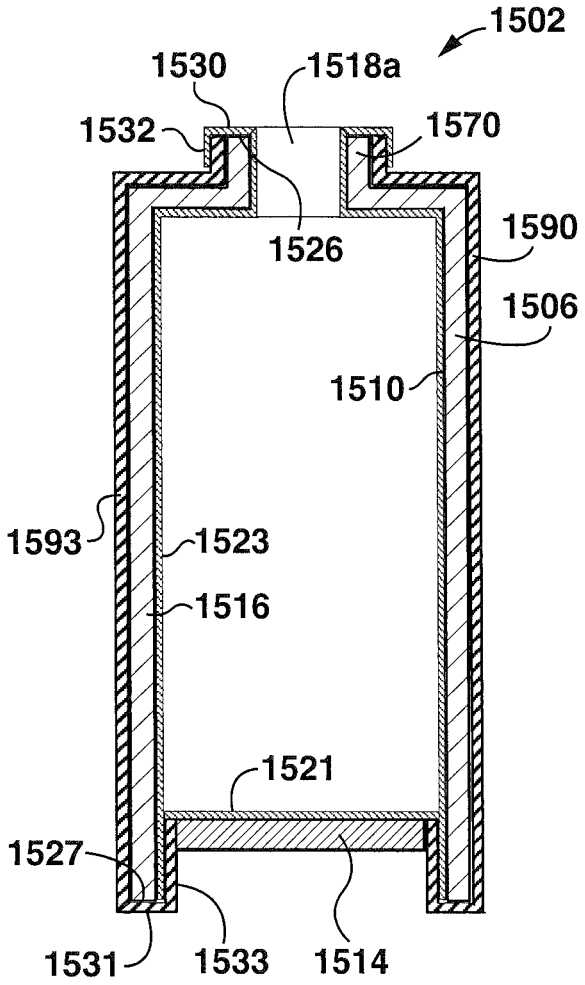
FIG. 15E is a cross-sectional view of the structural and liner layers of FIG. 15D, with the liner layer in a sealed configuration at one end of the container, and with the outer liner layer in a sealed configuration at the other end of the structural layer.

As shown in FIG. 15E, the overlap portion 1528 may then be manipulated and/or stretched during manufacturing to provide a radially extending lip 1530 that extends across the upper end face 1526 of structural layer 1506, and to also provide a downwardly extending skirt 1532 that extends along a portion of the outer surface 1592 of outer liner layer 1590. Overlap portion 1528 may be secured to outer liner layer 1590 and/or to neck portion 1570 of structural layer 1506, for example with the use of an adhesive. In this way, inner layer 1510 and outer liner layer 1590 may cooperate to provide a moisture-impermeable barrier surrounding the opening 1518*a*.

Referring still to FIG. 15E, in the example shown, an overlap portion 1594 (Shown in FIG. 15D) of outer liner layer 1590 may be manipulated and/or stretched during manufacturing to provide a radially extending lip 1531 that extends across a lower end face 1527 of structural layer 1506, and to also provide an upwardly extending skirt 1533 that extends along a portion of the tongue 1558 of liner layer 1510. Overlap portion 1594 may be secured to liner layer 1510 and/or to structural layer 1506, for example with the use of an adhesive. In this way, outer liner layer 1590 and tongues 1558 of liner layer 1510 may cooperate to provide a moisture-impermeable barrier surrounding the opening 1518*b* of structural layer 1506.

Referring still to FIG. 15E, in the example shown, a structural insert 1514 is positioned within lower opening 1518*b* to provide support for bottom panel 1521 of liner layer 1510, and/or to provide radial support for the lower portion of sidewall 1516 of structural layer 1506. Structural insert 1514 is dimensioned to be inserted into lower opening 1518*b* and to abut the tongue 1558 of liner layer 1510 and/or the skirt 1533 of outer liner layer 1590. Optionally, at least the lower surface of structural insert 1514 may be provided with a moisture-impermeable layer of coating.

In the example of FIGS. 15A to 15E, the container 1502 may optionally include a collar (not shown) as described above with respect to FIGS. 1 to 4, and/or a lid (not shown) as described above with respect to FIGS. 1 to 4 or FIG. 14.

In some examples, container 1502 may be characterized as a fully-immersible container, as the structural layer 1506 is protected from moisture on its inner and outer surfaces. Such a container may be useful, for example, for storing prolonged use consumables, such as kitchen and bath products, and yard and auto care products, and/or in environments where contact with moisture is expected, such as a kitchen counter, a refrigerator, and/or a garden shed. Such a container may emulate the properties of a typical plastic container, but may be more recyclable and/or compostable, and/or may be otherwise regarded as a more environmentally friendly container.

Figure 16:
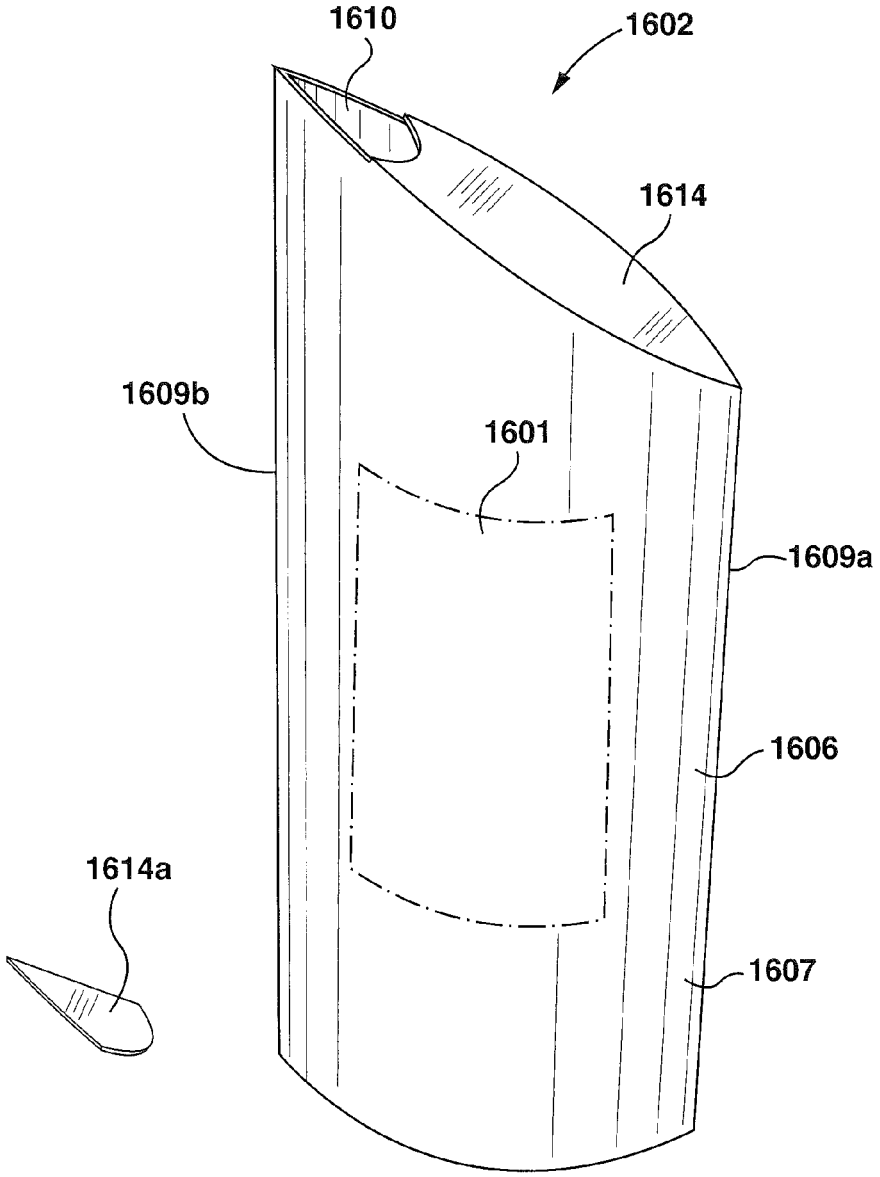
FIG. 16 is a perspective view of another example container.

Referring now to FIG. 16, an alternative example of a container 1602 is shown. In FIG. 16, like features as in FIGS. 1 to 4 are referred to with like reference numerals, with the first digit incremented by 15.

In this example, the structural layer 1606 comprises a pair of panels 1607. Panels 1607 are initially joined along a pair of edges 1609*a,b*. This allows structural layer 1606 to be 'flattened' by positioning panels 1607 in close proximity to each other. In such a 'flat' state, container 1602 may have a relatively compact and dense footprint (e.g. compared to an empty, rigid container such as a typical plastic water bottle), which may be advantageous e.g. during shipping of an empty container 1602. Accordingly, container 1602 may be characterized as a 'ships-flat' container.

In some examples, container 1602 may be dimensioned to have an interior volume similar to that of a typical water bottle intended for personal use (e.g. from about 250 mL to about 1.5 L), and to be graspable with one hand by a user. A container with such dimensions may be characterized as a 'ships-flat bottle'. Alternatively, container 1602 may be dimensioned to have an interior volume similar to that of a typical beverage container intended for personal use (e.g. from about 200 mL to about 300 or 500 mL), and to be graspable with one hand by a user. A container with such dimensions may be characterized as a 'ships-flat cup'. Alternatively, container 1602 may be relatively large and have a relatively heavy structural layer 1606.

Prior to filling container 1602, the interior surfaces of structural layer 1606 are provided with a liner layer 1610. Liner layer 1610 may define a watertight interior volume within structural layer 1606 (i.e. liner layer 1610 provides a sealed pouch within container 1602). Liner layer 1610 may be provided prior to 'flattening' the structural layer 1606, e.g. prior to shipping. Alternatively, liner layer 1610 may be provided after 'flattening' the structural layer 1606, e.g. after shipping.

The interior volume defined by liner layer 1610 may be shipped and stored in a sealed state and subsequently pierced during a filling operation, which may optionally be aseptic.

Before or after the interior volume defined by liner layer 1610 is filled, one or more end caps 1614 may be positioned between the panels 1607 of structural layer 1606. In FIG. 16, an example end cap 1614 is shown positioned at the upper end of structural layer 1606. Each end cap 1614 provides shape to container 1602 by resisting inward and/or outward deflection of panels 1607 of structural layer 1606. In some examples, end caps 1614 may additionally provide support for liner layer 1610.

In some examples, one or more end caps 1614 may be joined to panels 1607 during manufacturing (e.g. via a hinge or fiber strip), and may be folded or tucked between panels 1607 when structural layer is positioned in a 'flat' state. Optionally, end caps 1614 may be attached (e.g. via an adhesive) to liner layer 1610 prior to filling the interior volume defined by liner layer 1610. The end caps 1614 can be formed with one or more creases to allow folding or expansion of container. Alternatively, the end caps 1614 can be rigid and non-foldable.

Container 1602 may be filled via a (aseptic capable) fill port (not shown) that may be accessible e.g. through an opening in bottom end cap 1614. After filling of container 1602 (i.e. filling the interior volume of liner layer 1610) and sealing of the fill port, the fill port may be tucked inside container 1602 (e.g. between panels 1607 of structural layer 1606), and a patch (e.g. a fiber patch) may be optionally applied to cover any hole or other access opening in end cap 1614. In alternative examples, the fill port may be in the top end cap.

Filling of the container 1602 (i.e. filling the interior volume of liner layer 1610) will urge the panels 1607 of structural layer 1606 away from each other, which may be characterized as 'inflating' container 1602. In some examples, the filling or inflating of container 1602 may also urge one or more end caps 1614 that are attached to panels 1607 and/or liner layer 1610 into an aligned position between panels 1607, at which time the end caps 1614 may be further aligned (e.g. manually or via machine) into a final position. Once in the final position, end caps 1614 may be secured to one or both panels 1607 of structural layer 1606, e.g. using an adhesive.

In some examples, end caps 1614 are made of plant fibers and have sufficient strength and/or rigidity to keep the panels 1607 of container 1602 apart once the liner layer 1610 has been partially or fully emptied.

In some examples, end cap 1614 and/or liner layer 1610 may have a tear open feature to provide access to the interior volume of the container 1602, e.g. for pouring or drinking. As shown in FIG. 16, a portion 1614*a* of end cap 1614 may be perforated or otherwise configured to facilitate manual separation of a portion of end cap 1614 and/or panels 1607 of structural layer 1606.

In some examples, the fill port may be configured to provide access to the interior volume of a filled container 1602, e.g. for pouring or drinking. In some examples, the fill port may not be configured to provide access to the interior volume of a filled container 1602, e.g. for pouring or drinking.

In some examples, one or more labels 1601 may be provided on the exterior of container 1602.

Container 1602 may optionally include a collar (not shown) as described above with respect to FIGS. 1 to 4. Additionally, or alternatively, container 1602 may include a lid (not shown) as described above with respect to FIGS. 1 to 4 or FIG. 14. For example, container 1602 may be characterized as a 'ships-flat bottle with lid'. In some examples, the lid for container 1602 may be dimensioned to have an interior volume similar to that of a typical beverage container intended for personal use, and to be graspable with one hand by a user. Such a lid may also function as a cup, when removed from the container. The lid may optionally cover, seal, and/or protect the container 1602, or a portion of container 1602.

In some examples (not shown), container 1602 may be pleated to allow for greater volume upon expansion.

In the example shown, the upper end cap 1614 is inclined. In alternative examples, the upper end cap may be flat.

Container 1602 may be disassembled and the separated components can then be recycled and/or composted. In some examples, container 1602 may be configured to be separable by hand. For example, after an end user has emptied container 1602, the user may manually tear or otherwise separate liner layer 1610 from structural layer 1606, and recycle the former and compost the latter.

Even if the components of container 1602 are not separated following its use, the container 1602 may be returned to a 'flattened' state, which may e.g. reduce its volume during transportation to and/or storage in a landfill or similar waste disposal facility.

Figure 17A:
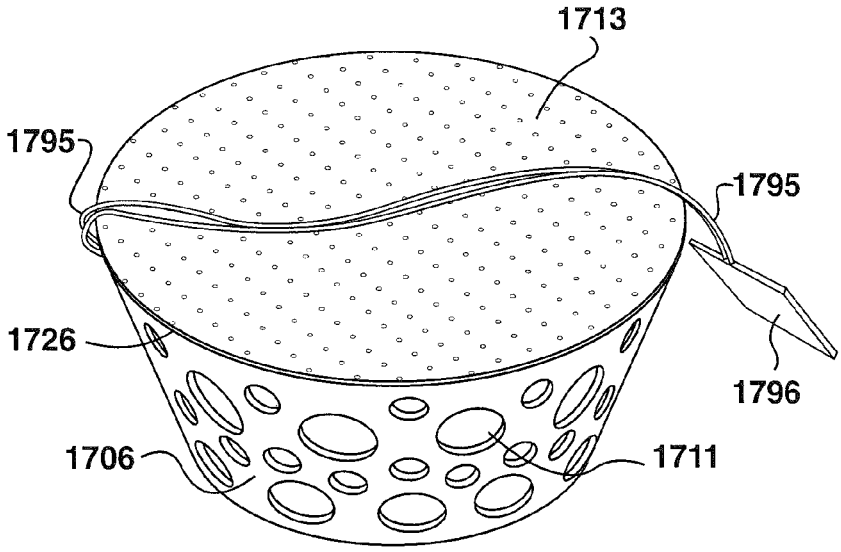
FIG. 17A is a perspective view of another example container in a partially unassembled configuration.
Figure 17B:
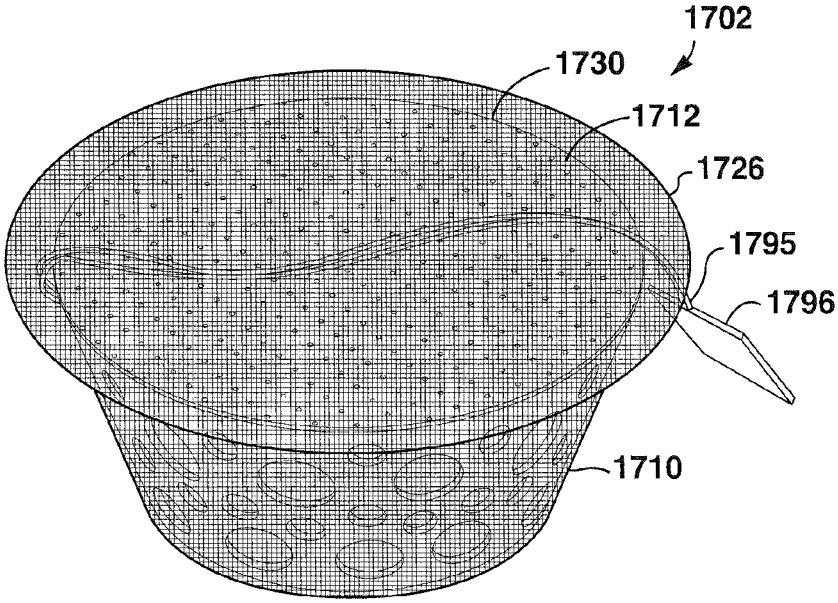
FIG. 17B is a perspective view of the container of FIG. 17A, in an assembled configuration.

Referring now to FIGS. 17A to 17B, an alternative example of a container 1702 is shown. In FIGS. 17A to 17B, like features as in FIGS. 1 to 4 are referred to with like reference numerals, with the first digit incremented by 16.

In this example, the container 1702 is a single use coffee pod. In such a coffee pod, the interior of structural layer 1706 is filled with coffee grounds, and optionally filter media 1711, as shown in FIG. 17A. Filter media 1711 may be in the form of an interior liner layer. The container 1702 also includes a lid portion 1713 made from a filter media. In some examples, the filter media/liner layer 1711 and lid portion 1713 may be integrally formed. Structural layer 1706 and its contents are then sealed using exterior (or outer) liner layer 1710 and second liner layer 1712, as shown in FIG. 17B, which are pre-formed polymeric liner layers.

In this example, container 1702 has an exterior (or outer) liner layer 1710 provided on an exterior (or outer) surface of bowl-shaped structural layer 1706. Liner layer 1710 is sealingly connected to a second liner layer 1712, which in this example acts a lid for container 1702. In some examples, exterior liner layer 1710 and second liner layer 1712 may be integrally formed.

In use, hot water (or another suitable liquid) is introduced into the interior of container 1702 by injecting through or otherwise piercing one or both of liner layers 1710, 1712. Once the hot water has mixed or otherwise reacted with the coffee grounds, brewed coffee is extracted through the same opening(s) in liner layers 1710, 1712 or through one or more different openings.

In the example shown, a thread or other cord 1795 is positioned about some or substantially all of the exterior of the upper end face 1726 of the structural layer 1706 of the container 1702. More specifically, thread 1795 is positioned within the seal between exterior liner layer 1710 and second liner layer 1712. One or both free ends of thread 1795 may be provided with a tab or other gripping surface 1796. In this way, a user can open container 1702 (e.g. after brewing) by pulling on thread 1795. Since thread 1795 is positioned within the seal between the liner layers 1710, 1712, continuing to pull on the thread 1795 acts to separate liner layers 1710, 1712 from each other, facilitating the removal of structural layer 1706 and/or its contents (e.g. used coffee grounds and/or filter media) from the liner layers.

In some examples (not shown), one end of thread 1795 may be attached to structural layer 1706. In this way, after thread 1795 has been pulled by a user to separate liner layers 1710, 1712 from each other, thread 1795 may still be attached to structural layer 1706, further facilitating the removal of structural layer 1706 and/or its contents (e.g. used coffee grounds and/or filter media) from the liner layers 1710, 1712.

Preferably, thread 1795 is made of a natural and/or compostable material, such as cotton, jute, linen, hemp, and the like.

After separation, plant-based structural layer 1706 and/or its contents may be composted (e.g. in a home composter or via a municipal composting program), while liner layers 1710, 1712 may be recycled or up-cycled separately from the plant-based material.

By facilitating the separation of structural layer 1706 and/or its contents (e.g. used coffee grounds and/or filter media) from the liner layers, container 1702 may be more recyclable and/or compostable than typical composite packaging material (e.g. as used in typical coffee pods), and/or may be otherwise regarded as a more environmentally friendly container.

In some examples container 1702 may be a single use coffee pod, sized to brew a single cup of coffee. In other examples, container 1702 may be sized to brew two or more cups of coffee, e.g. a carafe of coffee. Container 1702 may be used as a single use pod to brew or steep beverages other than coffee (e.g. tea, hot chocolate, and the like), by providing a suitable beverage concentrate, extract, or the like in the container prior to the introduction of hot water (or another suitable liquid) into the interior of container 1702.

With liner layers 1710 and 1712 sealingly coupled to each other, container 1702 may be characterized as a fully-immersible container, as structural layer 1706 is protected from moisture on its outer surfaces. Such a container may be useful, for example, for storing dry contents or other contents that may come into contact with structural layer 1706 without damaging or otherwise reacting with structural layer 1706, and/or in environments where contact with moisture is expected, such as a kitchen counter.

In any of the above examples, the adhesive used may be a soy based adhesive, a corn-based adhesive, a thermal adhesive, or another suitable adhesive. The adhesive used may be compatible with (e.g. able to adhere to) one or more materials. For example, a liner layer may be adhered to a structural layer using a single adhesive composition. The adhesive may be provided on one or both of the layers to be adhered to each other as a tape, a coating, and/or any other suitable pattern (e.g. an array of discontinuous dots).

As another example, a liner layer may be adhered to another liner layer using an adhesive compatible with both liner layers. For example, where two liner layers fabricated from a silicone polymer are being adhered to each other, a silicone to silicone glue (e.g. silpoxy) may be used. In some examples, one or more apertures or holes may be provided in a structural layer, and an adhesive may be provided in the apertures to allow two liner layers on opposite surfaces of the structural layer to be adhered to each other (and also thereby secured to the structural layer).

As another example, a structural layer may be adhered to another structural layer using an adhesive compatible with both structural layers. In some examples, one or more apertures or holes may be provided in a liner layer positioned between two structural layers, and an adhesive may be provided in the apertures to allow the two structural layers to be adhered to each other (and also thereby securing the liner layer between the structural layers). In any of the above examples, additional layers may optionally be applied to the container and/or the lid. For example, the container and/or the lid may include an inner liner layer of latex, as well as an outer liner layer of silicone.

Figure 18:
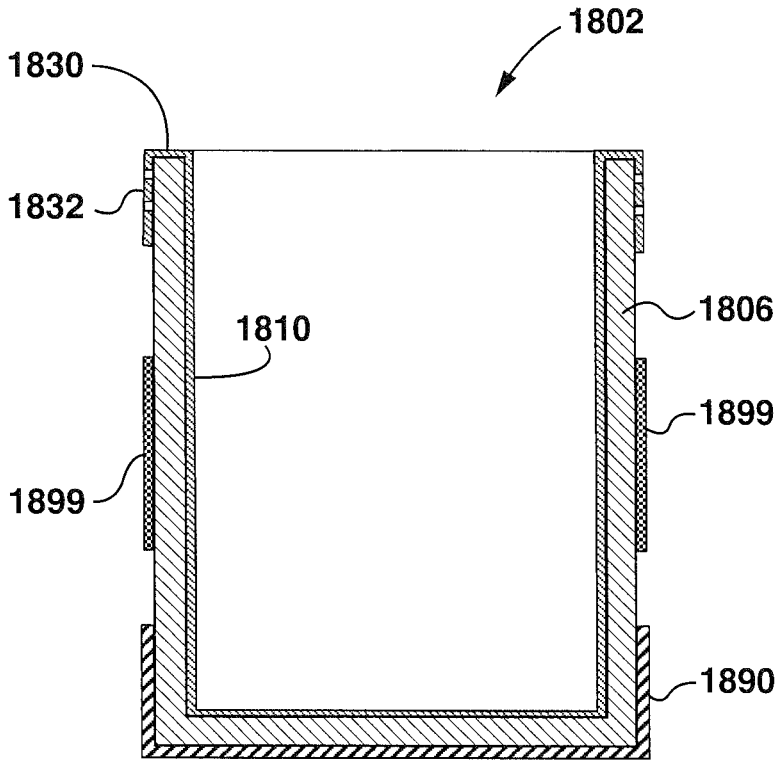
FIG. 18 is a cross-sectional view of another example container with a plurality of outer layers positioned on the exterior of the container.

For example, as shown in FIG. 18, an outer moisture-impermeable layer 1890 may be applied to a lower portion of the container, acting as a 'boot' or protective layer for containers placed on a wet surface. Alternatively, or additionally, an outer layer 1899 may be provided on the exterior of a container in a position where a user is expected to grip or otherwise handle the container (e.g. as a strip, a band, or any other suitable shape). For example, outer layer 1899 may act as a moisture and/or thermal barrier between the exterior surface of the container and a user's hand. Alternatively, or additionally, outer layer 1899 may be ribbed or otherwise textured to facilitate gripping of the container by a user.

In any of the above examples, moisture-impermeable layers may be provided on the interior and exterior surfaces of the container to provide a fully-immersible (e.g. waterproof) container.

In any of the above examples, liner layers with a high thermal tolerance may be provided on the interior and exterior surfaces of the container to provide a heat resistant container. For example, a container (e.g. in the shape of a tray) may include a fiber-based structural layer completely enveloped by one or more layers of high-temperature silicone such that the container may be able to withstand long periods in an oven at relatively high temperatures.

In any of the above examples, the structural layers may include a plurality of sub-layers. For example, the structural layer of the containers may include several sub-layers of thin bamboo plywood or bagasse paper. The sub-layers may optionally be adhered together with soy or corn based adhesives, which may be applied between adjacent sub-layers, or mixed into the pulp of the sub-layers. In some examples, the structural layer may include an inner sub-layer made from a coarse and minimally refined fiber, and an outer layer made from a fine fiber.

In any of the above examples, the liner layers may include a plurality of sub-layers. For example, the liner layer of the containers may include a first sub-layer of a polymeric material, such as a silicone polymer, latex, or a bioplastic, and a second sub-layer of a thin (or 'ultra-thin') natural fiber. The sub-layers may optionally be adhered together with soy or corn based adhesives, which may be applied between adjacent sub-layers, or mixed into the pulp of the natural fiber sub-layer.

In any of the above examples, a very thin layer of plant fiber (e.g. about the thickness of wrapping or tissue paper) may be provided on the exterior of the container. Such a thin layer of plant fiber may be provided with a very thin coating of compostable soy or other compostable plant based wax on the outside surface of the container. Providing such a thin waxed layer as a separate from the main structural layer of fiber may facilitate the recycling of the main structural layer, as the thin waxed layer may be removed prior to composting or recycling the structural layer. (The thin waxed layer may be composted separately, as it may be difficult to process at typical recycling facilities). Alternatively, the thin waxed layer and the main structural layer may be composted without separating the layers.

In any of the above examples, one the container and/or the lid may optionally include one or more handles. The handle(s) may optionally be integrally formed with one of the structural layers.

In any of the above examples, the structural layer(s) may include ridges, corrugations, and/or other strengthening patterns.

In any of the above examples, food or other materials may be molded directly in the container. For example, the container may be filled with a gelatin-based food in liquid form. The gelatin-based food may form to a semi-solid state in the container, and be molded to the shape of the container. The gelatin-based food may then be removed from the container, for example by inverting the container, and may retain the shape of the container. In further alternate examples, foods such as baked goods may be cooked in the liner layer (optionally with the use of a carrier). The liner layer, containing the cooked food, may then be inserted into and secured to the structural layer.

In further examples, the packages described herein may be used to finish foods, such as cakes or other baked goods, as is described in PCT Application No. PCT/CA2013/000443. For example a container described above may be partially filled with icing. A cake, having a volume that is smaller than the volume of the container so that a gap exists between the cake and the container, may then be pressed into the icing in the container, so that the icing fills the gap between the cake and the container. A lid may then be secured to the container, and the cake may be shipped and/or stored and/or sold in the container. The iced cake may be removed from the container.

The packages described herein may optionally be made in the form of, for example, a bottle, a jar, a tube, a pouch, a box, a jug, a tube, or a tray.

In any of the above examples, a soy based ink may optionally be applied to the outer surface of the structural layer(s), in order to provide information or a decorative effect. Further, in any of the above examples, a food grade shellac may be applied to the outer surface of the structural layer(s), to provide an aesthetic effect. Further, in any of the above examples, a clay glaze may be applied to the outer surface of the structural layer. Some such materials may provide moisture resistance to the container.

In any of the above examples, an optional additional seal may be included on the container. For example, a foil seal may be applied across the opening 118, and may be adhered to the liner 110.

In any of the above examples, the packages and/or containers may be for short-term use, or for long-term use. Packages and/or containers that are intended for long-term use may in some examples have a relatively thick liner layer and/or a relatively thick support layer.

In any of the above examples, the package or container may be shipped in a flattened state. For example, the structural layer of the container may be foldable into a flattened state, and the liner layer of the container may be sufficiently flexible to be flattened. The structural layers and liner layers may be secured together when flattened, or may be separate. If separate, the structural layers and liner layers may be assembled and secured together after shipping, for example by un-flattening each layer, inserting the liner layer into the structural layer, and securing the layers together.

In any of the above examples, the package or container may include an additional gas impermeable layer, such as an oxygen impermeable layer. Such a layer may be separable from the other layers of the container.

In any of the above examples, the package or container may have a transparent panel for viewing its contents. For example, the structural layer may have a cutout portion, and the liner layer may be transparent, so that the contents of the package or container can be viewed through the cutout.

An example method of manufacturing the containers described above will presently be described. In order to manufacture the container 102, the structural layer 106 may be formed from a plant based material, for example by molding, as described above. The liner layer 110 may then be separately formed, for example by molding the liner layer from a polymer, as described above. Alternatively, the liner layer may be formed on one or both sides of a thin carrier sheet, such as a thin sheet of plant based material.

The pre-formed liner layer 110 may then be mated with the structural layer 106, for example inserted into the structural layer 106 so that the pre-formed liner layer 110 lines the structural layer 106. In alternative examples, a structural layer may be inserted into a liner layer.

The pre-formed liner layer 110 may then be secured to the structural layer 106, for example may be removably secured with an adhesive or a mechanical securing mechanism. As noted above, this may allow for the pre-formed liner layer 110 to be removed from the structural layer 106, and each of the pre-formed liner layer 110 and structural layer 106 may be recycled.

In some examples, the method for securing the pre-formed liner layer 110 to the structural layer 106 may involve the use of a separate piece, such as the collar 134, which may be secured over the liner layer 110. More specifically, as described above, an overlap portion 128 of the pre-formed liner layer may be positioned on an outer surface 122 of the structural layer 106, and the threaded collar 134 may be positioned over the overlap portion 128. The threaded collar 134 may then be adhered to the structural layer 106 via apertures 135 in the overlap portion 128.

In some examples, the method for securing the pre-formed liner layer to the structural layer may optionally include positioning a portion of the pre-formed liner layer between two portions of the structural layer, and pinching the portion of the pre-formed liner layer between the two portions of the structural layer to frictionally secure the pre-formed liner layer to the structural layer, and/or adhering the two portions of the structural layer together via apertures in the portion of the liner layer. For example, in the case of container 502, the tongue 558 may be positioned in the groove 556 between opposed walls of the groove 556, and may be pinched between the opposed walls of the groove 556. Alternatively, in the case of container 702, the flanges 765, 767 of the liner layer 710 may be positioned between the flanges 764*a*, 766*a* of the first side piece 706*a* and the flanges 764*b*, 766*b* of the second side piece 706*b*. The flanges 764*a*, 766*a* of the first side piece 706*a* may then be adhered to the flanges 764*b*, 766*b* of the second side piece 706*b*, via apertures in the flanges 765, 767.

In some examples, the pre-formed liner layer may be modified after being mated to and/or secured to the structural layer. Such modifications may include heating or sonic welding to enhance water proofing or gas impermeability, or to enhance the bond between the liner layer and the structural layer.

While the above description provides examples of one or more processes or apparatuses, other processes or apparatuses may be within the scope of the accompanying claims.

The invention claimed is:

1. A container comprising:

a) a plant based structural layer having an inner surface and an opposed outer surface; and b) a pre-formed polymeric liner layer secured to the plant based structural layer and lining at least one of the inner surface and the outer surface;

wherein the structural layer comprises a pair of flexible panels, each panel having a pair of opposed side edges, the pair of panels being joined to each other along the side edges, the container movable between a flattened configuration in which the panels are flattened to provide a flat container, and an expanded configuration in which the panels are flexed outwardly to define an interior volume of the container therebetween.

2. The container of claim 1, further comprising at least one end cap for retaining the container in the expanded configuration.

3. The container of claim 1, wherein the pre-formed polymeric liner layer is removably secured to the structural layer.

4. The container of claim 1, wherein the liner layer is secured to the structural layer with an adhesive.

5. The container of claim 1, wherein the liner layer is mechanically secured to the structural layer.

6. The container of claim 1, wherein the liner layer is fabricated from silicone.

7. The container of claim 1, wherein the structural layer is fabricated from bagasse.

8. A container comprising:

a) a plant based structural layer having an inner surface and an opposed outer surface; and b) a pre-formed polymeric liner layer secured to the plant based structural layer and lining at least one of the inner surface and the outer surface, wherein the pre-formed polymeric liner layer is removably secured to the structural layer; and c) a liquid-permeable filter media positioned interior of the structural layer, wherein the pre-formed polymeric liner layer comprises a first liner layer lining the outer surface, and a second liner layer secured to at least one of the structural layer and the first liner layer and sealing the filter media within a volume defined by the inner surface of the structural layer and the second liner layer.

9. The container of claim 8, further comprising a thread secured at a first end to the filter media, a second end of the thread being adapted to be grasped by a user, whereby the filter media can be separated from the structural layer by pulling on the second end while restraining the structural layer.

10. The container of claim 9, wherein the first end of the thread is secured about a perimeter of an upper end of the filter media.

11. The container of claim 9, wherein the first end of the thread is also secured about a perimeter of the second liner layer.

12. The container of claim 9, wherein the second liner layer, the filter media, and the thread are compostable.

* * * * *